United States Patent [19]

Tompkins et al.

[11] Patent Number: 5,053,827

[45] Date of Patent: Oct. 1, 1991

[54] METHOD AND APPARATUS FOR INTERMITTENT CONDITIONING OF A TRANSFER BELT

[75] Inventors: E. Neal Tompkins, Atlanta; Jack N. Bartholmae, Duluth; Peter A. Zuber, Norcross; Kirk W. Charles, Atlanta, all of Ga.

[73] Assignee: Colorocs Corporation, Norcross, Ga.

[21] Appl. No.: 422,770

[22] Filed: Oct. 17, 1989

[51] Int. Cl.[5] ..... G03G 21/00

[52] U.S. Cl. ..... 355/271; 355/77; 355/326; 355/299; 355/296; 430/126

[58] Field of Search ..... 355/273, 271, 244, 326, 355/327, 299, 77, 296; 430/126, 33, 42, 48

[56] References Cited

U.S. PATENT DOCUMENTS

| | | | |
|---|---|---|---|
| 4,341,455 | 7/1982 | Fedder | 355/274 |
| 4,453,820 | 6/1984 | Suzuki | 355/273 X |
| 4,588,279 | 5/1986 | Fukuchi et al. | 355/271 |
| 4,652,115 | 3/1987 | Palm et al. | 355/275 X |
| 4,684,238 | 8/1987 | Till et al. | 355/275 |
| 4,690,539 | 9/1987 | Radulski et al. | 355/275 X |

*Primary Examiner*—R. L. Moses

*Attorney, Agent, or Firm*—Ross, Howison, Clapp & Korn

[57] ABSTRACT

A belt conditioning system for a flexible belt electrophotographic print engine includes a cleaning blade (144) which is operable to clean a transfer belt (20) on a per page basis. A roller (152) is operable to be disposed in contact with the belt (20) on a page intermittent basis to more aggressively condition the belt (20). A controller (39) is operable to activate the roller (152) on a page intermittent basis and, during activation of the roller (152), transfer of images to the transfer belt (20) from a PC belt (30) is inhibited to prevent any registration problems from occurring during the conditioning cycle.

35 Claims, 7 Drawing Sheets

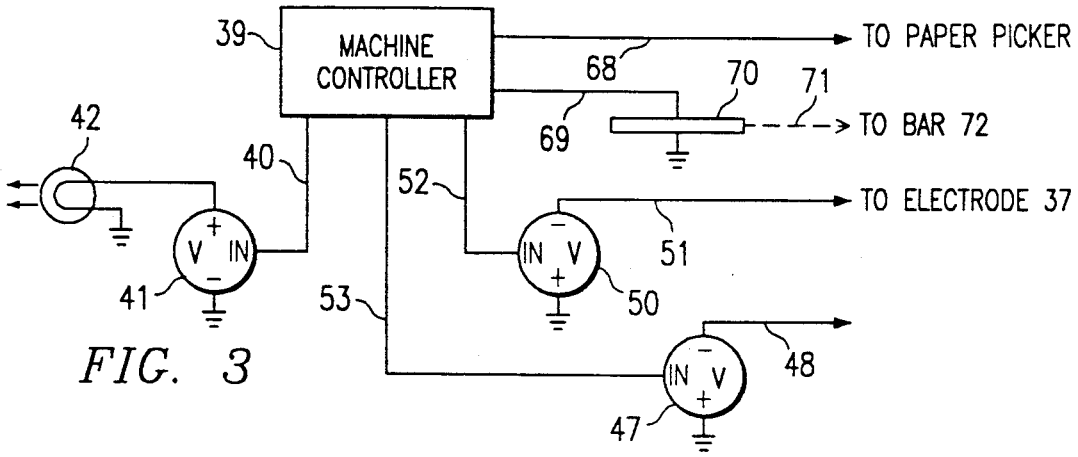
FIG. 3
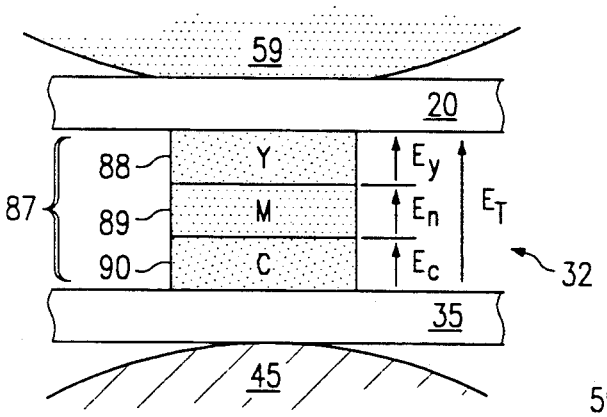
FIG. 5B
FIG. 5A
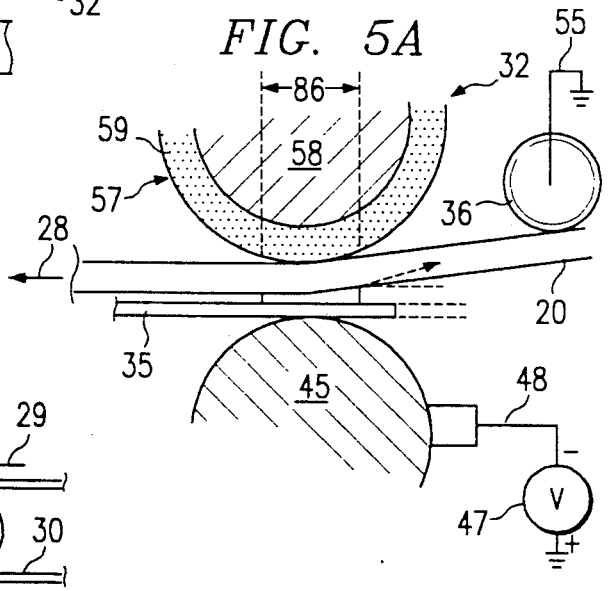
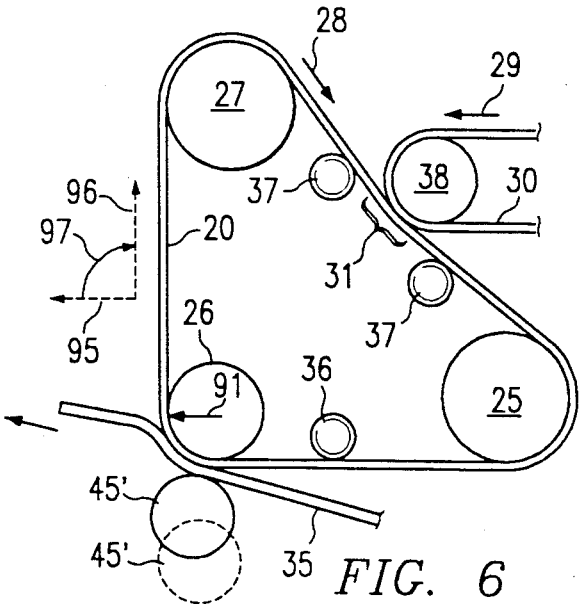
FIG. 6

FIG. 13a
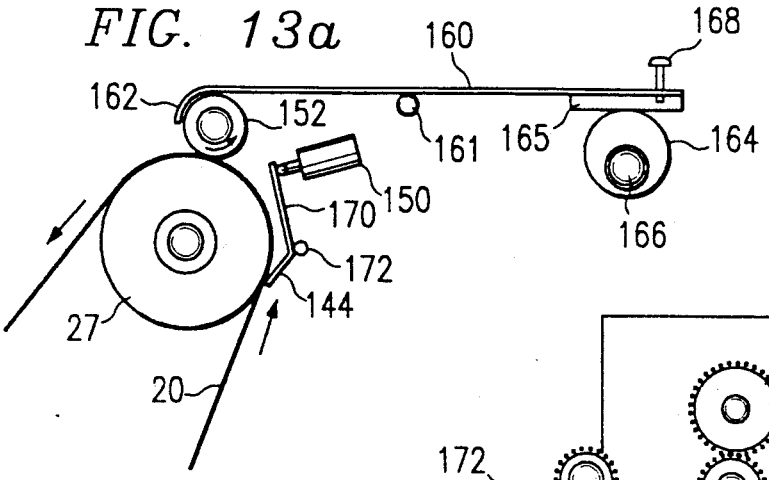
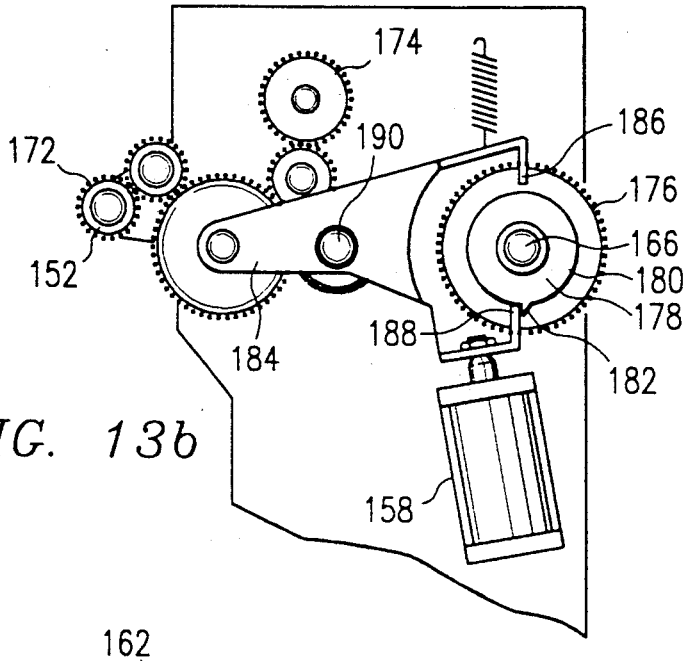
FIG. 13b
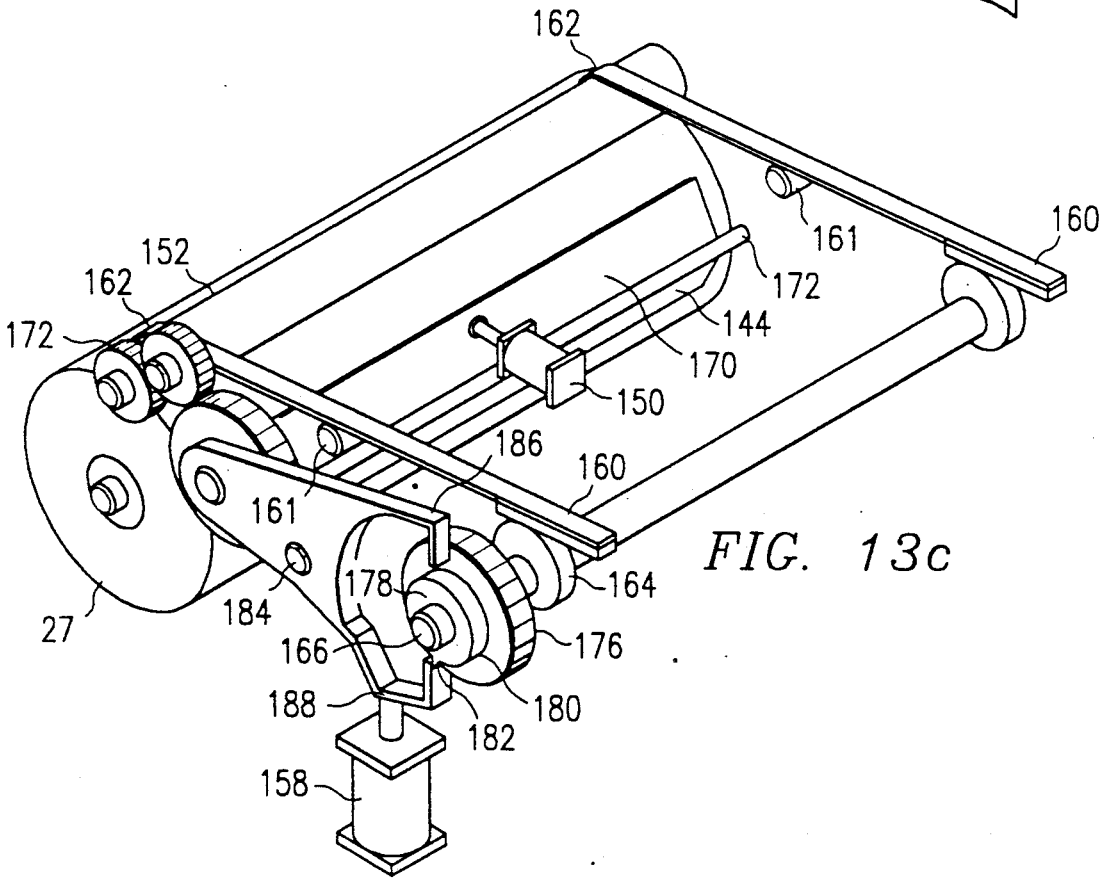
FIG. 13c

METHOD AND APPARATUS FOR INTERMITTENT CONDITIONING OF A TRANSFER BELT

TECHNICAL FIELD OF THE INVENTION

The present invention pertains in general to electrophotographic print engines and, more particularly, to a method and apparatus for conditioning a transfer belt in the print engine.

BACKGROUND OF THE INVENTION

Print engines utilizing flexible belts rather than drums as a carrier for the engine's photoreceptor have been described in U.S. Pat. No. 4,652,115, issued to Palm et al. on Mar. 24, 1987 and assigned to the assignee of the present invention. In this flexible belt system, sequential images are formed on a photoreceptor belt and then transferred to an intermediate transfer belt in an overlapping fashion to form a final composite image on the final transfer belt. This composite image is then transferred to a final image receptor such as a sheet of paper. In the operation of this transfer belt, it is necessary to rotate the belt three entire revolutions for each three color composite image prior to a transfer to the final sheet of paper. Each revolution of the belt corresponds to a "plane" and for every three revolutions corresponding to a full composite image is referred to as a "page".

At the end of each page, i.e., for each three revolutions, it is necessary to remove any residual toner from the intermediate transfer belt prior to initiating the next page. This is not necessary with the systems that do not utilize the intermediate transfer belt since the receptor of the images that form the composite images is completely removed in the form of a sheet of paper. This is typical with drum systems. However, since the same transfer medium is utilized for subsequent copies, it is important that the surface characteristics of this medium be repeatable for each new page.

Typically, the surface of flexible belts has been "conditioned" or cleaned with the use of either a polishing roller or a cleaning blade. The polishing roller can be either a very fine brush or a very smooth surface which rotates in the opposite direction of travel of the belt with a predetermined velocity and a pressure. In comparison, a cleaning blade is disposed at a predetermined angle and pressure. By varying the parameters, the "aggressiveness" with which the cleaning member attacks the surface of the belt will be varied. The surface characteristics such as surface charge, etc. on the belt will be affected by these cleaning mechanisms. The present invention relates to the surface characteristics.

It has been noticed that subtle image defects occurred, which have been referred to as fine line breakup, for multiple copies. Although not entirely understood, this appears to be due to a change in the characteristics of the belt which are due to the toner, the application of electricity and to the general cleaning procedure. In connection with the flexible belt system utilizing an intermediate transfer belt, this problem is somewhat exacerbated in that the action of the cleaning mechanism must be interacted with the dynamics of the system. This is due to the fact that the cleaning system is only used at the end of each page when all three component images have been transferred to the intermediate transfer belt to form the composite images and the image transferred. The cleaning mechanism is then activated to clean off any residual toner and then the first component image for the next page transferred. The cleaning mechanism is then deactivated such that the cleaning operation is "page intermittent".

An important aspect of the cleaning mechanism with respect to the intermediate transfer belt is that the cleaning mechanism is activated at the end of one page for a part of the revolution of the transfer belt. However, while the cleaning mechanism is activated, transfer of at least the first one of the component images is being made. Therefore, it is important that the interaction between the cleaning mechanism and the registration of the belt be maintained. If any slippage occurs as a result of the cleaning operation and the interaction between the transfer belt and the cleaning mechanism, this could present problems. Therefore, registration provides some limitations to how much interaction the cleaning mechanism can have with the transfer belt. Although the cleaning mechanism of the present removes the unwanted toner, additional conditioning of the belt may be required in order to ensure that the characteristics of the belt are somewhat uniform; that is, conditioning is needed for the transfer belt.

SUMMARY OF THE INVENTION

The present invention disclosed and claimed herein comprises an electrophotographic print engine having at least one flexible belt for transporting a developed image for transfer therefrom. The print engine includes a conditioning mechanism for conditioning the flexible belt at a first and predetermined conditioning level to alter the surface characteristics thereof on a page intermittent basis. The conditioning mechanism is held inoperative for at least one page in a sequence of n pages processed by the print engine.

In another aspect of the present invention, the conditioning mechanism is operable to provide conditioning of the belt only after transfer of the image from the belt. Further, a second level of conditioning is provided by the conditioning mechanism that operates on a non-page intermittent basis such that conditioning of the belt operates at a second level on each page. The second level of conditioning operates only after transfer of the image from the flexible belt.

In yet another aspect of the present invention, the flexible belt is operable to receive overlapping and previously developed multiple component images to form a single composite image for each page of operation of the print engine. A transfer device is provided for transferring the composite image to a receiving body after formation thereof. The conditioning device is operable after the composite image is transferred and before the first composite image for the next page is received in a sequence of n pages processed by the print engine.

In a yet further aspect of the present invention, the operation of the print engine is inhibited during the step of conditioning such that the conditioning step does not interfere with the normal operation of the machine.

BRIEF DESCRIPTION OF THE DRAWINGS

FIG. 3 illustrates a block diagram of the voltage stepping apparatus;

FIG. 5A illustrates a detail of the composite image transfer station of FIG. 2, diagrammatically representing image transfer at the station;

FIG. 5B illustrates a detail diagrammatic representation of the composite image transfer shown in FIG. 5A;

FIG. 6 illustrates a side elevational cross section of an alternate embodiment of the transfer stations of FIG. 1;

FIG. 7B illustrates a diagrammatic representation of the electric fields at the separated image transfer station during transfer of the third developed image;

FIG. 13 illustrates a detailed mechanical view of the belt conditioner; and

DETAILED DESCRIPTION OF THE DRAWINGS

Figure 1:
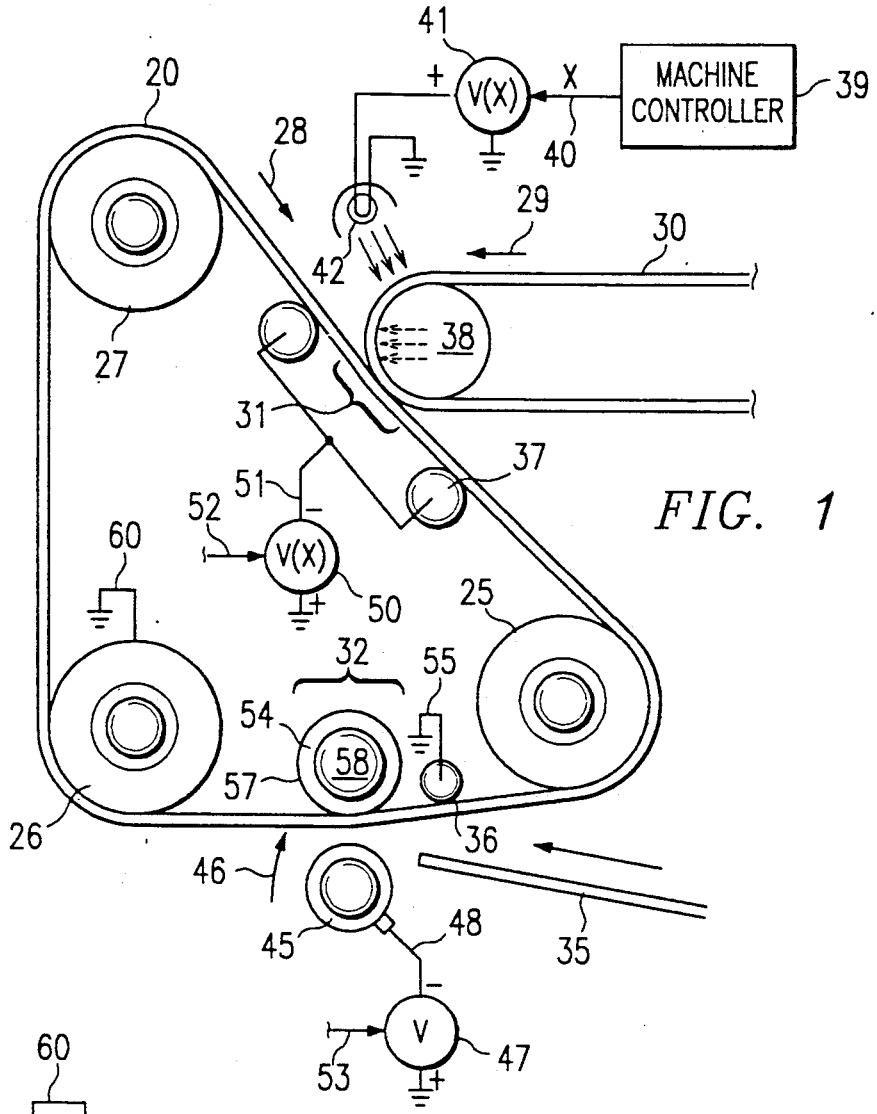
FIG. 1 illustrates a side elevational view of the two transfer stations.

Referring to FIG. 1, there is illustrated an elevational diagram of the transfer stations of a two belt double transfer full color electrophotographic print engine generally of the type disclosed in U.S. Pat. No. 4,697,920 to Palm, et al. It should be noted that the structure shown in FIG. 1 is similar to the double transfer system shown in FIG. 6 of Palm 4,697,920 in that a transfer belt 20 is wrapped around three rollers 25, 26 and 27 and driven in the direction of arrow 28. U.S. Pat. No. 4,967,920 is hereby incorporated by reference exactly as if set forth in full herein. Arrow 29 shows the direction of the movement of the photoreceptor. Images developed on photoreceptor 30 are transferred to transfer belt 20 at a separated image transfer station 31. A composite developed toner image is transferred to an image receptor, embodied by paper 35, at a composite image transfer station 32. Roller electrodes 36 and 37 contact the inside of transfer belt 20. Photoreceptor belt 30 rotates about roller 38 at transfer station 31.

A machine controller 39 represents the overall synchronized digital controller of the type disclosed in U.S. Pat. No. 4,697,920, incorporated by reference hereinabove. An output which appears on line 40 is connected to a variable voltage source 41, the output of which drives predischarging lamp 42. A movable transfer roller 45 is disposed at composite image transfer station 32 and can be selectively moved in contact with belt 20 in the direction of arrow 46 under the control of machine controller 39.

A voltage source 47 is connected by conductor 48 to a brush 49 which in turn contacts the surface of roller 45. This is used to maintain a negative potential on roller 45. A second voltage source 50 is connected by conductor 51 to roller 37. Voltage source 50 is a controlled voltage source, the output of which is controlled by a voltage signal on line 52 from machine controller 39 (see FIG. 3).

In the preferred embodiment, roller 36 is maintained at a ground potential through conductor 55 which may be connected to the roller through a brush, metallic contact, or any other suitable arrangement. A roller at composite image transfer station 32 includes a metallic core 58 and a rubber outer coating 59. Roller 26 is maintained at ground potential through a grounded conductor 60.

Figure 2:
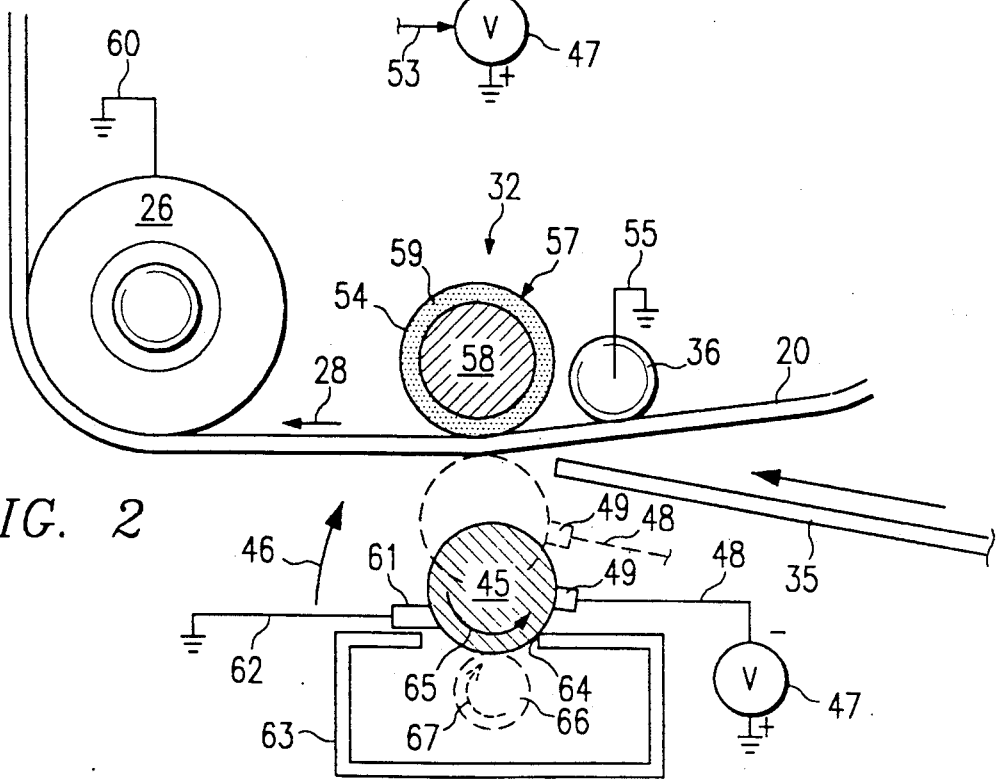
FIG. 2 illustrates a side elevation section view of the composite image transfer station.

Referring now to FIG. 2, there are illustrated details of composite image transfer station 32. As noted hereinabove, roller 45 is selectively movable between the position shown in FIG. 2 and its position shown in phantom thereon. As represented in FIG. 2, brush 49 retains its contact with roller 45 in either position. A second brush 61 is connected to ground through conductor 62 and contacts roller 45 only when it is in the lower position shown in FIG. 2.

When roller 45 is in its lower position, it rotates in the direction of arrow 65 under the influence of a drive roller, shown in phantom at 66. Driven roller 66 rotates in the direction of arrow 67. In the preferred embodiment, roller 45 is belt driven off any convenient linkage to another rotating member since it is not critical that rotation of roller 45, when in the down position, be synchronized to the machine speed. Therefore, driving roller 66 may be of any convenient diameter and, within practical limits may rotate at any speed sufficient to make sure roller 45 accomplishes several rotations each time it is in the down position.

When the roller 45 is in the down position, it is brought into contact with a cleaning station consisting of tray 63 and cleaning blade 64. As noted above, roller 45 is rotated under the influence of rotating member 67 when roller 45 is in the down position. This causes cleaning blade 64 to contact the periphery of roller 45 and to scrape off any residual toner particles present thereon. In the preferred embodiment, blade 66 is integrally formed with one edge of the opening of cleaning station tray 63. However, other more conventional forms of cleaning blades can be used in place of blade 66 in embodiments of the present invention.

The fact that brush 61 contacts roller 45, and gives same a secure electrical path to ground through conductor 62 when in the down position, assures that electrostatic forces tending to hold any toner particles on roller 45 are discharged.

Since roller 45 contacts the bottom (that is, the non-image side) of paper 35 during image transfer, it ideally would not ever have any toner particles thereon. However, there is particle spill, particles within the atmosphere of the machine, and other ways for contaminant toner particles to arrive at the surface of roller 45. Since it is held at a relatively high negative potential during image transfer, it tends to attract any available positively charged toner particles. Furthermore, since it does contact the non-image bearing side of the paper, it is important that the roller be very clean so as not to deposit extraneous pigments on the back side of the paper which will be fused thereto during passage of the paper through the fuser (not shown).

Before continuing with the description of the physical structure of the transfer stations, a simple schematic of the control of the variable voltage sources used in the preferred embodiment is shown in FIG. 3. Machine controller 39 has been described hereinabove as of the type disclosed in U.S. Pat. No. 4,697,920. Lines 40 and 52 go to variable voltages sources 41 and 50, respectively. Another output line 68 goes to activate a conventional paper picker (not shown) when it is time to feed a sheet of image receptor into composite image transfer station 32 (FIG. 2). An additional control line 69 from machine controller 39 operates solenoid 70. Solenoid 70 is indicated by dashed line 71 as having a mechanical connection to bar 72 shown in FIG. 4.

Figure 4:
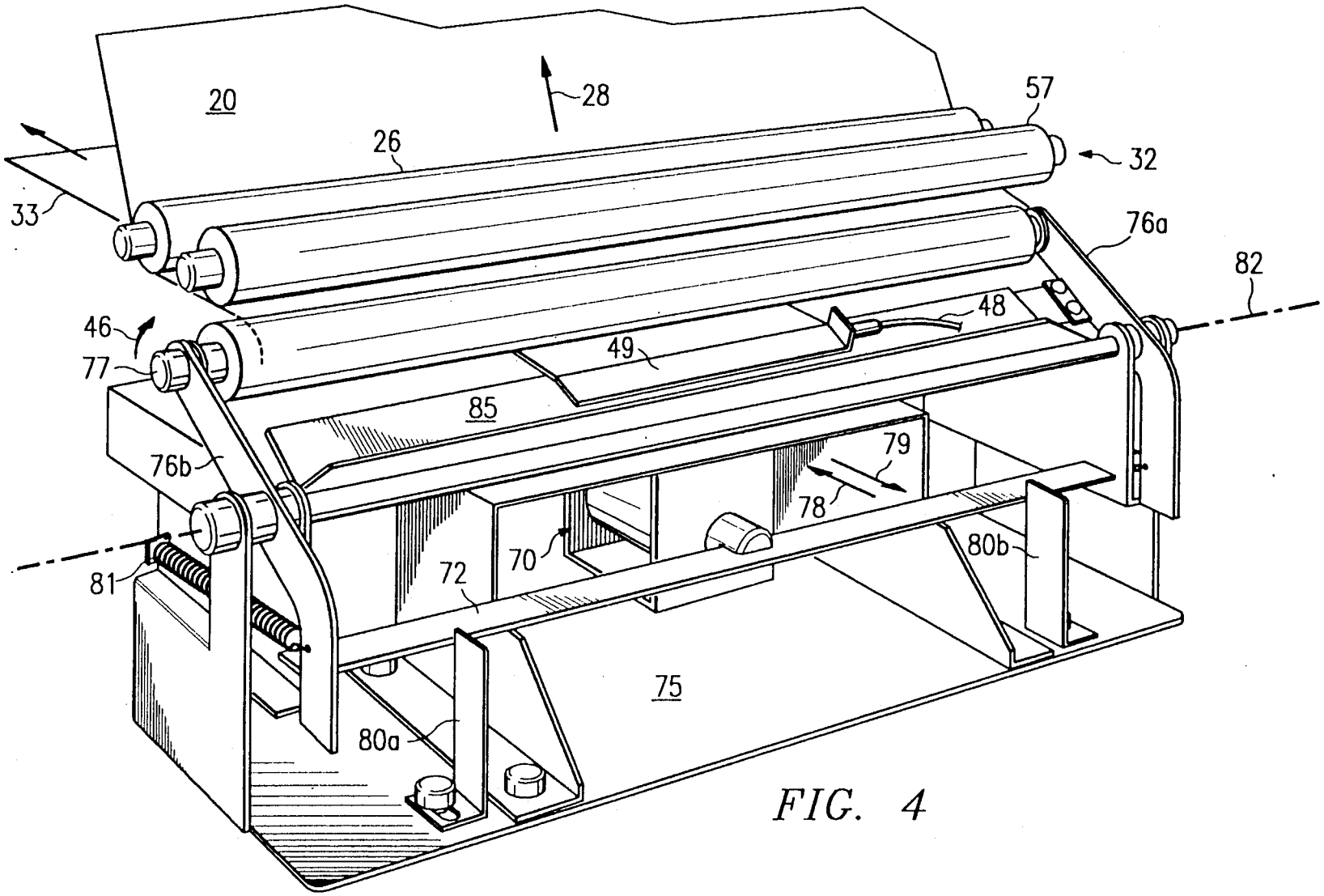
FIG. 4 illustrates a pictorial view of the lower portion of the composite image transfer station.

Additionally, line 53 controls voltage source 47, the output of which appears on conductor 48, which in turn is provided to brush 49, which is in contact with roller 45. The signal on line 53 simply turns voltage source 47 on and off when in its up and down positions, respectively. When in the down position, the voltage source needs to be off so that it is not shorted by roller 45's contact with grounded brush 61. In the event voltage source 47 ever fails to turn off, the grounding of roller 45 through brush 61 in its down position will short the roller to ground causing an appropriate overcurrent device (not shown) in the physical embodiment of voltage source 47 to trip, thus protecting the user from coming in contact with a high voltage potential on roller 45. This is an important safety factor because, as shown in FIG. 4, when the preferred embodiment of the present invention is opened, the user can easily establish hand contact with roller 45.

Voltage source 41 controls the output of predischarging lamp 42 too illuminate photoreceptor belt 30 just prior to a developed image reaching separated image transfer station 31, as shown in FIG. 1. The voltage output from voltage source 41 is adjusted in a step wise fashion as each developed separated image approaches transfer station 31. The control signal on line 40 adjusts the output of control voltage source 41 to determine the luminous flux density output from predischarge lamp 42 in accordance with the absorption characteristic of the particular toner used to develop the separated image approaching transfer station 31.

In embodiments of the present invention in which four toner materials are used, including monochrome black toner, the predischarge lamp 42 is illuminated during passage of the developed black image to reduce back transfer of subsequent color toners. This is because black toner materials have a high absorption characteristic. It should be noted that the black toner materials being developed first in such embodiments provides two operating advantages. First, since the predischarge lamp 42 is ineffective with black toner materials, it is desirable to have maximum uniformity of the electric field at transfer station 31 when the black toner materials are transferred because the advantage of predischarging the photoreceptor is not obtained. There is also better uniformity of subsequent toner transfer since the toner layers will not be subjected to higher transfer voltage required for black transfer (no previous discharge), which is especially true in undeveloped black area. Therefore, the black toner material is transferred first and does not have to contend with any previously transferred toners on transfer belt 20.

An additional advantage is obtained from developing the black toner first since it will then be the first toner image laid down on transfer belt 20. In a double transfer system, toner materials appear in the composite image transferred to the image receptor in the opposite order from that in which they were developed. Thus, the first toner material (black in this instance) developed and transferred to transfer belt 20 is the farthest away from paper 35 when the composite image is transferred thereto. This puts the black toner materials on top where they can do the maximum good in providing additional fill for dark image areas. It should be noted that the use of four color development is contemplated in applications of the print engine in the present invention having digitized signal sources such as laser printers and copying machines employing digitized scanners. In these applications, the black toner can be used either as the only toner which develops an image at each pixel where the image processing apparatus detects a black output, or can be used to selectively fill and enhance highly saturated black or near black areas of the image.

As may be seen from FIG. 3, in the preferred embodiment the actual parameter controlled is the voltage output from controlled voltage source 41 driving lamp 42. The voltage of control signal 40 is empirically adjusted until a uniform discharge characteristic is obtained for the photoreceptor belt having a uniform density per unit area of toner materials of the various pigments deposited thereon. From this, it can be determined that the luminous flux density output from lamp 42 is adjusted in accordance with the absorption characteristic of each toner.

Additionally, it should be understood that the voltage controlling voltage source 41 can be empirically adjusted so that the luminous flux density through each color pigmented toner material during operation of predischarge lamp 42 provides the most uniform transfer of toner materials when creating process black in a fashion that compensates for any variations due to the stepped applied electric fields during image transfer at transfer station 31, and the variable triboelectric charge characteristics of the differently pigmented toners, described in detail hereinbelow. This is because it may not turn out that a constant discharge characteristic on the underlying photoreceptor is, in fact, the most desirable parameter in a full color machine in which the applied electrostatic field differs for each pigment and the triboelectric charge characteristics of the toners differ for each pigment.

A signal output on line 52 from controller 39 controls the output from voltage source 50 which is connected by line 51 to plate 37 (FIG. 1). The output on line 51 is a negative voltage and is stepped according to the particular one of the developed separated images being transferred onto transfer belt 20. The magnitude of the output on line 51 increases with the transfer of each sequential developed image in building up a composite developed image on transfer belt 20. As may be seen from inspection of FIG. 1, a negative voltage on plate 37 creates an electric field between the electrode represented by grounded roller 38 and plate 37, which field passes through belt 20 and the other materials at transfer station 31.

Turning next to FIG. 4, a pictorial view of the portion of the preferred embodiments shown in FIGS. 1 and 2 is seen. FIG. 4 should assist the reader in understanding, in a three dimensional perspective, the physical embodiment of the apparatus represented diagrammatically in FIGS. 1 and 2. FIG. 4 is a perspective view of a portion of a copying machine which is the environment of the preferred embodiment of the present invention. A frame 75 carries the apparatus of composite image transfer station 32 and is rigidly fixed to the lower portion of a body of the machine.

Movable roller 45 is mounted on a pivoting carriage constructed of rocker arms 76*a* and 76*b*, bar 72, and a mandrel shown at 77. Roller 45 rotates about mandrel 77. Solenoid 70 contacts bar 72 and moves same back and forth in the directions of arrows 78 and 79 shown in FIG. 4.

Electrical brush 49 is connected to conductor 48 and remains in constant contact with roller 45 as shown in FIGS. 1 and 2. The brush and conductor are carried on another bar 85 which is rigidly attached to arms 76*a* and 76*b*. This keeps the brush in constant contact with roller 45.

An engagement spring 81 is under tension and urges bar 72 in the direction of arrow 78 shown in FIG. 4. Movement of bar 72 in this direction causes the moveable carriage carrying roller 45 to rotate about axis 82, thus raising the roller toward its engagement position in which it contacts belt 20 and urges same against roller 57.

The operation of this mechanism is as follows. When solenoid 70 is deactivated, an internal spring (not shown) pushes bar 72 in the direction of arrow 79 with sufficient force to overcome the tension exerted by spring 81. Travel of bar 72 is limited by stops 80*a* and 80*b*. Roller 45 is disengaged from transfer belt 20 under these conditions. When machine controller 39 (FIG. 3) detects that a complete composite developed image has been created on transfer belt 20, and that same is approaching transfer station 32, a signal is provided on line 68 (FIG. 3) to a conventional paper picker (not shown) and a sheet of paper 35 is moved into transfer station 32 between transfer belt 20 and roller 45.

Under the timed control of machine controller 39, solenoid 70 is activated when the leading edge of the paper is just past the center line of the transfer station so that the top portion of paper will be pressed between roller 45 and belt 20. When this condition occurs, solenoid 70 is activated causing it to pull in and overcome the force of its internal spring. This removes the influence of solenoid 70 from the pivoting carriage and bar 72 moves in the direction of arrow 78 in response to the tension applied by spring 81. It will therefore be appreciated that under these conditions, roller 45 moves upward in the direction of arrow 46 contracting the paper which is urged against belt 20 and roller 57. It should be noted that this arrangement allows spring 81 to determine the force with which roller 45 is urged up against belt 20.

Controller 39 outputs a signal on line 53 to activate voltage source 47 (FIG. 3). Since brush 49 is mounted on bar 85, which in turn is rigidly attached to the pivoting carriage, brush 49 remains in contact with the roller and establishes the electrical potential thereon.

When transfer of the developed composite image to paper 35 is completed, solenoid 70 is once again turned off and its internal spring urges bar 72 in the direction of arrow 79, overcoming the tension applied by spring 81 and roller 45 returns to its disengaged position. Voltage source 47 is then turned off.

When roller 45 returns to its disengaged position, rotating member 66 (not visible in FIG. 4) engages what is the right hand end of mandrel 77 as the mandrel is seen in FIG. 4. The cleaning station consisting of tray 63 and cleaning blade 64 is not shown in FIG. 4.

Referring now to FIG. 5A, there is illustrated a detail of transfer station 32 is shown with a diagrammatic representation of toner representing a developed composite image. An important aspect of composite transfer station 32 is its length, i.e. the distance represented by dimension line 86 in FIG. 5A.

The following should be understood with respect to all drawing figures representing toner transfer at transfer stations 31 and 32 in this specification. These drawings are not intended to be to scale and some of the neat boundaries between toner layers and the like are, for obvious reasons, only approximations to what physically occurs as toner is transferred between image receiving webs in the preferred embodiment. The toners are under considerable physical force and, naturally, there is some compression and mixing. However, the diagrams represent models adopted by the present inventors in analyzing transfer problems encountered in full color electrophotographic print engines. The strikingly improved results obtained by the present invention from applying the results of these models to solve transfer problems which plagued the prior art, demonstrates that the models are valid for purposes of analyzing performance of such a print engine.

The length of transfer station 32, shown by dimension line 86, is made possible primarily by the use of rubber covering 59 on roller 57. As spring 81 (FIG. 4) urges roller 45 upward, rubber coating 59 is deformed, as shown in FIG. 5A, and a broad area for the nip is created in the transfer zone. This has several beneficial effects described hereinbelow.

In FIG. 5B, the developed composite image is represented by toner 87, as shown within transfer station 32. The applied electric field is generated between roller 45 which is held to a constant potential between −600 and −2,000 volts preferably approximately −1,000 volts, and plate 36 which is grounded by conductor 55. The applied field may be conveniently analyzed by breaking it down into component portions shown as $E_p$,$E_t$, and $E_b$, which represent the electric fields across the paper, the toner in the composite image, and belt 20, respectively. As is known to those skilled in the art, at a transfer station for transferring toner to a final image receptor, the substantial majority of the voltage of the applied field is dropped in field component $E_p$, the field across the paper. This is particularly true for papers of the type commonly used in the United States and Europe which tend to be relatively thick bond, as compared to thinner papers commonly used in the Orient.

The beneficial results of the substantial length of transfer station 32 of the preferred embodiment are essentially as follows. First, the dwell time of the composite image and the paper in the transfer station is increased. The dwell time is the length of the dimension presented by line 86 divided by the speed at which the paper moves through the transfer station in the direction of arrow 28. It has been found empirically that increased dwell time increases the overall efficiency of forward transfer.

A second beneficial result of the pressure applied by roller 45 is its tendency to compress the toners of composite image 87. In the preferred embodiment, spring 81 (FIG. 4) applies approximately one to five kilograms of force over the entire nip area represented by dimension line 86. it should be noted that an equivalent circuit model between belt 20 and paper 35 includes a substantial capacitance of the toners of composite image 87. Since both the belts and the paper are relatively incompressible, as compared to toner image 87, the physical characteristics of the belt and the paper determining field components $E_b$ and $E_p$ remain substantially constant, as compared to those parameters determining field component $E_t$ for the toner. As the toner is squeezed in transfer station 32, it has the same effect as bringing the plates of a capacitor closer together wherein the plates hold a substantially constant charge. Under this analysis, belt 20 and paper 35 constitute the plates of the capacitor. As is well known to those skilled in the art, bringing the plates of capacitor closer together wherein the charge on the plates remain substantially constant, lowers the voltage across the capacitor. Thus, as the toner image 87 is squeezed in the transfer station, the field component $E_t$ across the toner decreases. This tends to reduce the repulsive forces on the top layers of toner and aids in complete transfer of the entire composite image.

At this point, it is appropriate to explore the benefits derived from selection of proper surface resistivity for belt 20. As is known to those skilled in the art, materials considered good insulating surfaces are usually classified as those having resistivities on the order of $10^{14}$ ohm or more. The inventors of the present invention have found that maintaining the surface resistivity of transfer belt 20 in the range of $10^7$ to $10^8$ ohm has substantially beneficial results in a transfer station constructed according to the present invention. The inventors have used carbon filled polyvinyl fluoride and carbon filled polyvinylidine as belt materials. However, there are numerous other polymers which can be doped with carbon to create belts of appropriate physical characteristics which also have surface and bulk resistivities within the desired range set forth herein.

It is believed that the following model explains the benefits derived from using a belt with a surface resistivity in the range specified herein. First, consider the situation in which electrical breakdown occurs between roller 45 and belt 20. When this occurs, electron current (in the opposite direction of mathematical current) will ten to flow from roller 45 into belt 20 toward grounded plate 36. Providing belt 20 with a surface resistivity in the above described range assures a high enough resistivity such that substantial current limiting occurs in the event of a breakdown and serious damage to the belt does not occur.

Second is the fact that the surface resistivity of belt 20 is low enough to allow dissipation of local maxima of charge which thus prevents breakdown from occurring in the first place. Local maxima of charge can occur from areas of high toner concentration, and the non-uniform distribution of triboelectric charge on particular portions of the toner materials forming the image. When local charge maxima accumulate, extremely high electric field intensities around small areas can be created and thus tend to cause breakdown. Proper selection of the surface resistivity of the belt, aided in part by the selection of slightly conductive developer materials (described hereinabove) allow the local charge maxima to dissipate and spread out so that the field strength tends to remain uniform over the nip area 86 of transfer station 32. This prevents breakdown from occurring in the first place.

Additionally, the relatively high surface conductivity of belt 20, as compared to those used in the prior art, allows plate 36 to be displaced along the direction of travel of belt 20 from the transfer station and still be properly used as one of the electrodes in creating the applied field for causing toner transfer. This allows the very simple expedient of a metallic electrode to be used, thus eliminating the need for additional brushes or commutator rings on a roller such as roller 57. It should also be noted that if roller 57 were held to a constant potential to create the applied electrostatic field across the transfer zone, it would be extremely difficult, if not impossible, to use a roller having rubber coating 59, which coating allows the wide area of the nip at the transfer station to be created in the first place.

Also, as shown in FIG. 5A, the electrostatic field components $E_b$ within belt 20 lies in a direction from transfer station 32 toward grounded plate 36. Therefore, there is a substantial physical distance between transfer station 32 and plate 36 which constitutes one electrode used in generating the applied field. The substantial distance insures adequate dielectric strength, thus overcoming the problems one would expect to encounter if a low resistivity belt were used in a transfer station at which the field applying electrodes were directly opposite each other on opposite sides of the belt. By providing a current limiter, the bulk resistivity aids in preventing electrical breakdown in the area of transfer station 32.

Referring now to FIG. 5B, an advantage of the order in which the toner pigments were developed in the preferred embodiment will now be described. FIG. 5B is a detailed diagrammatic representation of a highly saturated composite image for developing an area of the final image on final image receptor 35 which is intended to be process black. Therefore, equality densities of yellow toner 88, magenta toner 89 and cyan toner 90 have been deposited during the transfer of the toner materials comprising composite image 87. Again, the spacing represented in FIG. 5 is not intended to be to scale, but to only illustrate the principles involved in the mechanisms which affect toner transfer at composite image transfer station 32.

In the preferred embodiment when three processed colors are used, they are developed on photoreceptor 30 in the order yellow, magenta, cyan. In commercial full color electrophotographic print engines manufactured by Xerox Corporation, it is recommended that this be the development order in single transfer full color electrophotographic print engines. The disclosure of U.S. Pat. No. 3,729,311 to Langdon indicates that colors can be developed in any suitable order which, in abstract principle, is true. Langdon disclosed a preferred development order of yellow, cyan, magenta.

However, the order of pigment deposit on the final image receptor impacts the qualitative perception of imperfections in the color reproduction or printing process which results from imperfections in the toner transfer mechanisms used in the print engine.

Since yellow, magenta, and cyan are the convention order of development in conventional single transfer full color electrophotographic print engines, the pigments appear on the paper in the same order, i.e. yellow closest to the paper, followed by magenta, with cyan on top.

The preferred embodiment of the present invention develops the colors in the same order but is a double transfer system, and thus the order in which the pigments appear on page 35 is reversed from that which is normally encountered. Thus, as shown on FIG. 5B, in the preferred embodiment toner pigments are deposited on the paper in the order cyan, magenta, with yellow on top.

To understand the advantage of pigment order, consider the electric field components shown in FIG. 5B.

The toner portion of the total electric field $E_t$ is the linear combination of the electric field across each of toner layers 88 through 90, $E_y$, $E_m$, and $E_c$, respectively. The toner deposits 88 through 90 each consist of collections of plastic materials having triboelectric charges of the same polarity thereon. Therefore, there are significant repulsion forces tending to push toner layers 88 and 89 away from toner layer 90. It will be immediately appreciated that toner layer 88 is under the combined influence of the repulsive forces from the positive charges within toner layers 89 and 90. Therefore, at composite image transfer station 32 yellow toner layer 88 is being repulsed by the positively charged layers 89 and 90 and thus, if the triboelectric charge characteristics tend to be equal, is the most likely candidate to fail to transfer to paper 35 with maximum efficiency.

By selecting yellow as the upper toner pigment with respect to the image which gets transferred to the final print receptor, the following benefits are obtained. First, it should be understood that yellow may be properly characterized as the pigment which is hardest to see among the three pigments normally used in color electrophotography. The first main advantage from this selection of pigment order is the spectral characteristic of imperfections in the transfer for highly saturated areas, such as the process black area illustrated in FIG. 5B. When less yellow pigment than is desired ultimately gets transferred to the final print receptor,l the flawed areas where the yellow pigment transfer was incomplete tend toward blue. Therefore, the absence of complete transfer of yellow moves the spectrum of a saturated area from process black toward a dark blue. If yellow and cyan are reversed, the absence of complete transfer of cyan would move the spectrum of a saturated area from process black toward a red or yellow hue.

As shown in FIGS. 1 and 2, roller 26 is maintained at a ground potential through a connection to ground shown as conductor 60. This assists in discharge of belt 20 and paper 35 as they pass roller 26 on the way to the machine's fuser (not shown). Successful discharge of paper 35 assists in preventing the paper from adhering to belt 20 as the belt makes its turn around roller 26.

The grounding of roller 26 assists in dissipating residual charge on paper 35 and belt 20 as they pass and which also prevents paper 35 from adhering to belt 20 as it goes around roller 26. This helps prevent paper jams at the transfer belt fuser junction.

Additionally, it should be noted that the grounding of roller 26 helps maintain the uniformity of the electric field at the toner/transfer belt junction at transfer station 32. Again, reference is made to FIG. 5A in which the electric field within belt 20 is shown as pointing from the toner/transfer belt junction toward grounded plate 36. Those skilled in the art will understand that the construction of the device shown in FIG. 1 puts a large conductive surface, in the form of roller 26, also at ground potential disposed at the down stream side of transfer belt 20. Thus, there is a similar E field within the belt pointing in the direction from transfer station 32 towards roller 26. This tends to establish symmetry of the E field within the transfer belt at the boundaries of transfer station 32. While the foregoing is not believed necessary by the inventors of the present invention, it is believed that it is an additional benefit which is obtained from providing a good conductive path to ground through roller 26.

Also, as noted hereinabove, it is primarily a coincidence that the numerical values of the preferred range of surface and bulk resistivities are identical in the preferred embodiment. While there is certainly a relationship between the two, it is both possible and reasonably common to construct belts having surface and bulk resistivity characteristics which differ substantially when the first is expressed in ohms and the latter is expressed in ohm centimeters. It is important in constructing preferred forms of the present invention to select the bulk resistivity characteristic for the material of belt 20 such that it will discharge substantially 90 percent of the surface charge induced thereon during one revolution of the belt.

Referring now to FIG. 6, a moveable roller 45' is selectively moved into and out of a position in which it contacts transfer belt 20 opposite a roller 26', which corresponds to roller 26 shown in the previous embodiment. The particular electrical connections are not shown on the corresponding elements of FIG. 6 but it should be understood that they are identical to those shown in FIG. 1. Thus, plate 36 and roller 26' are grounded, roller 45' has a negative transfer potential applied thereto, etc. As shown in FIG. 6, it is preferred to make roller 26' a passive roller and of smaller diameter than rollers 25 and 27. Note that the embodiment of FIG. 6 is one in which the advantage of wide nip area to the transfer station which results in the use of rubber coating 59 in the previous embodiment is forsaken in favor of reduced expense and simplicity. As the diameter of roller 26' is reduced, there is a corresponding reduction in radius of curvature 91 for the path belt 20 takes around roller 26'. The smaller this radius of curvature, the more paper 35 will tend to peel away from belt 20 and prevent jams at the transfer station to fuser junction of the paper path.

It is the believed that a rubber coated roller may also be used at the position of 26' and the loss of benefits from grounding this roller may be offset by the benefits of increasing the length of the transfer station. If the roller is sufficiently small, the tendency of the paper to peel away from the belt, even in the presence of considerable residual static charge, should prevent paper jams. The use of a three point suspension system for transfer belt 20 also provides the advantage of allowing the length of the transfer station to be increased at the same time providing a relatively sharp turn at the point at which the paper 35 is to be detached from belt 20.

Illustrated in FIG. 6 is the relationship between the direction of travel belt 20 as it approaches the transfer station, indicated by arrow 95, and the direction the belt travels as it leaves the transfer station and passes around roller 26', indicated by arrow 96. The angle drawn between a vector representing the direction of travel during approach to the transfer station and the direction of travel as the belt exits the transfer station and rounds a roller thereat is shown as 97, and is defined in this specification to be the approach to exit angle. Bond papers commonly used in electrophotographic engines in western countries will tend to reliably peel away from the transfer belt.

The advantage of an additional wrap, thus increasing dwell time in a transfer zone, is obtained at transfer station 31 by the relative positioning of rollers 25, 27 and 38 so that there is a wrap or overlap creating a long transfer zone 31 at the PC belt to transfer belt interface. This general principle was previously disclosed in FIG.

6 and the discussion thereof, in U.S. Pat. No. 4,697,920 in Palm et al.

At the photoreceptor to transfer belt transfer station 31, the same principles described hereinabove with respect to the electric field component within belt 20 as transfer station 32, apply. The polarity is reversed in that voltage source 50 which is connected to plate 37 places a negative voltage on the inside of the transfer belt with respect to the grounded photoconductor roller 38. However, the advantages obtained from use of a belt having a surface resistivity within the range recited in this specification all manifest themselves at transfer station 31, as well as transfer station 32.

Additionally, it should be noted that because these advantages manifest themselves at both transfer stations, the principles described and claimed herein are equally applicable to double transfer systems such as the system disclosed in the preferred embodiment, and a single transfer system in which belt 20 was used, with an appropriate paper retaining mechanisms such as a vacuum plenum, to retain a sheet of image receptor as it moves about the path traveled by belt 20 to make multiple passes by photoreceptor 30. Thus, the fact that in the preferred embodiment belt 20 is an intermediate transfer belt should not disguise its nature as an image receiving web, as defined herein, which could also be used to carry a web of a final image receptor such as a sheet of paper.

The advantages to be obtained from selection of triboelectric charge characteristics for the toner materials used in the preferred embodiment will now be described in connection with FIGS. 7A and 7B. As described hereinabove, the transfer voltage applied by source 50 is stepped according to the particular one of the developed images being transferred from photoreceptor 30 to transfer belt 20, i.e., whether it is the first, second, or third image.

As described hereinabove, the stepped transfer voltages take values of −250, −325, and −400 for the yellow, magenta, and cyan toner, respectively. This is to overcome the effects of previously transferred toner layers when the second and third toners are transferred from photoconductor belt 30. The stepped voltages, combined with the use of predischarge lamp 42, have been found to substantially eliminate back transfer problems in the preferred embodiment.

As noted in the Background of the Invention section, the inventors of the present invention have discovered that they believe the teaching of U.S. Pat. No. 4,093,457 to Hauser, et al (assigned to Xerox Corporation) is exactly the opposite of what can be combined with the above described mechanisms to produce optimum forward transfer characteristics in a color electrophotographic print engine. Hauser teaches sequentially increasing the triboelectric charge characteristics of the toners used in developing sequential separated images. It is Hauser's teaching that this helps eliminate back transfer.

The inventors of the present invention believe that the use of predischarging, such as that embodied by predischarge lamp 42 and its controlled voltage source 41, together with the stepping of the transfer field applied by voltage source 50 substantially overcomes the back transfer problem. Thus, the present inventors believe that stepping of triboelectric charge may be most advantageously used to prevent commonly encountered problems of getting forward transfer to take place in the first place in color electrophotographic print engines. Tests of this theory show that sequentially increasing the triboelectric charge of the toner materials produces improved forward transfer characteristics without exacerbating back transfer as taught by Hauser.

The principles which the present inventors believe are involved are illustrated in connection with FIGS. 7A and 7B. FIGS. 7A represents the electric field conditions as photoreceptor belt 30 approaches transfer belt 20 at the entrance to transfer station 31.

As described in the Background of the Invention, it is often difficult to achieve design goal in creating color electrophotographic print engines to apply a uniform electrostatic attraction between each toner image developed hon the photoconductor belt and the image receiving web to which the image is to be transferred. The primary problem is overcoming the effects of previously transferred toner materials, as well as the boundaries in the charged and discharged areas of the photoconductor itself. In FIG. 7A arrow 110 represents the applied electric field resulting from the potential difference between plate 37 and the ground potential of roller 38. Arrow 111 represents the force per unit mass that the applied E field exerts on toner materials 88 on photoconductor belt 30.

Figure 7A:
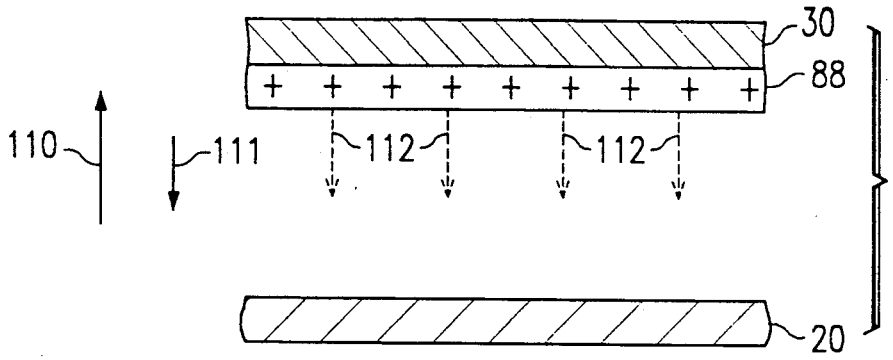
FIG. 7A illustrates a diagrammatic representation of the electric fields at the separated image transfer station during transfer of the first developed separated image.
Figure 7A:
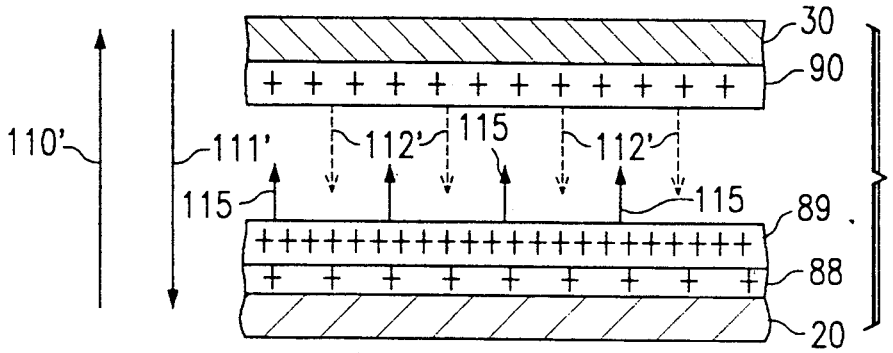

For comparison's sake, it should be noted that in FIG. 7B, arrow 110' represents the magnitude of the applied electric field between plate 37 and roller 38 and arrow 111' represents the force per unit mass, resulting solely from the applied E field, on toner particles 90 which are attached to photoreceptor belt 30. Again, the precise lengths of these arrows are not intended to be quantitatively precise, but to qualitatively represent the relationship between the two conditions. The density of the plus signs ("+") shown in toner elements 88, 89 and 90 in FIGS. 7A and 7B represent the relative triboelectric charge characteristics among the yellow, magenta, and cyan toners, respectively. Therefore, in FIG. 7B, arrows 110' and 111' are shown as being of equal length whereas arrow 111 is shorter than arrow 110 in FIG. 7A. This indicates that for a specified value of the applied E field, the force per unit mass on the toner particles which results solely from the contribution of the applied E field, is proportional to the triboelectric charge characteristics for those particular toner materials. Thus, the relative length of arrow 111 as compared to arrow 110 is less than arrow 111' as compared to arrow 110', for the respective cases illustrating the forces on toner particles 88 and toner particles 90. Since toner particles 88 have a lower triboelectric charge, a given applied E field exerts less force per unit mass on these particles.

In FIG. 7A, arrows 112 represent the resultant force per unit mass on the particles of toner material 88 as a result of applied E field 110. Note that arrow 111 and arrow 112 are of substantially equal length. This is because, for the transfer of the first developed image consisting of toner materials 88, the applied E field represented by arrow 110 makes substantially the only contribution to the force. Note that for purposes of discussion of FIGS. 7A and 7B, any residual attraction between transfer belt 30 and the toner materials lying thereon is not taken into account. So long as predischarging of photoreceptor belt, as described hereinabove, is accomplished in a satisfactory manner, it is appropriate to ignore any such attraction as describing this model for use of stepped triboelectric charge characteristics.

FIG. 7B represents the forces on cyan toner particles 90 during the transfer of the last developed separated image from photoreceptor 30 to transfer belt 20. Arrows 115 represent the repulsive force per unit mass exerted on toner particles 90 by the previously transferred toner particles 88 and 89. Since all the triboelectric charges are of like polarity, previously transferred toner layers 88 and 89 tend to repel the charges on toner particles 90. However, in the situation illustrated in FIG. 7B applied E field 110 is greater, and the force per unit mass on toner particles 90 resulting from the applied E field, shown as 111', is also greater. Therefore, arrows 112' represent the net force per unit mass exerted on toner articles 90 which results from the applied E field represented at 110' and the electrostatic repulsion forces from the previously transferred toner layers represented by arrows 115.

The increase in attractive force per unit mass is a result of the contribution of the increased applied electric field on the last toner layers and the fact that it has the highest triboelectric charge density. These parameters are selected to offset repulsive forces 115 and to thereby generate forces tending to transfer the toner particles 90 from the last image which are substantially identical to those on toner particles 88 during transfer of the first image (FIG. 7A). The electrostatic repulsion forces represented by arrows 115 in FIG. 7B are kept to a practical minimum because of the lower triboelectric charge characteristic of toners 88 and 89. In the print engine described in the Hauser patent, the first transferred images in the positions corresponding to those of toners 88 and 89 in FIG. 7B are of the highest triboelectric charge. Thus, while boundary areas on photoreceptor 30 will tend to produce less attraction back to the photoreceptor on these charges, due to their strong tendency to adhere to the image receiving web under the influence of an applied electric field, a strong triboelectric charge concentration in this position increases the repulsion forces on the subsequently transferred toner materials. It is believed by the inventors of the present invention that this reduces effective forward transfer in the first place, leading to poor performance.

In the preferred embodiment of the present invention, the stepping of the average triboelectric charge characteristics for the toners is given according to the following table.

| Toner Sequence | Toner Pigment | Average Triboelectric Charge (microcoulombs per gram) |
|---|---|---|
| 1 | yellow | 8-10 |
| 2 | magenta | 10-12 |
| 3 | cyan | 10-14 |

As noted hereinabove, the entire 8 to 14 microcoulombs per gram range which encompasses all three toner materials used in the preferred embodiment is lower than what the prior art teaches is appropriate for providing good forward transfer characteristics. It should also be noted that modes steps, both proportionately and in absolute values of microcoulombs per gram, have been found by the present inventors to produce the advantageous results described herein.

It should be noted that other color electrophotographic print engines typically user toners with triboelectric charge characteristics falling in the range of 15 to 25 microcoulombs per gram. Only the last transferred toner described in Hauser, having a characteristic of 6 microcoulombs per gram, falling within the preferred range of the present invention. Additionally, Hauser's described preferred values for stepped charges include a seven fold decrease between the first toner and the last toner, going from 44 microcoulombs per gram to 6.

While Hauser's invention may help reduce back transfer in the type of machine described in his application, the inventors of the present invention have discovered that the order and range of stepped charged described in Hauser makes it very difficult to get an effective pull on the last layer to be transferred, due to both its very low triboelectric charge, thus reducing the force per unit mass from the applied electric field, as well as the greatly increased repulsive forces from the first two layers transferred. Thus, for Hauser's device to achieve good forward transfer high applied fields must be used with the problems which typically result therefrom.

Figure 8:
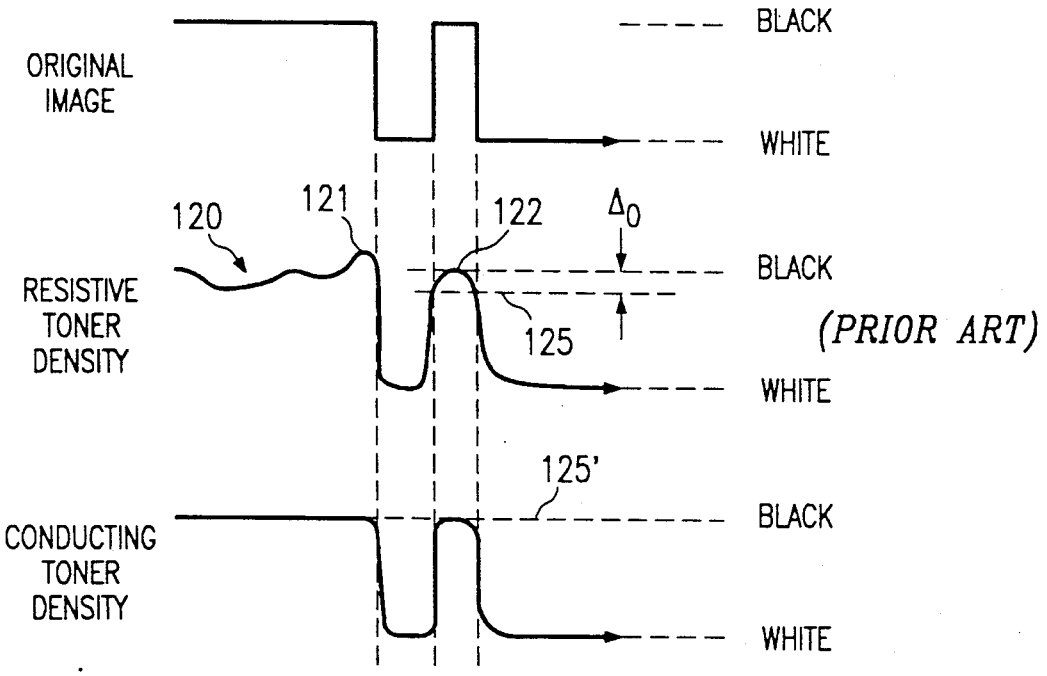
FIG. 8 illustrates a composite diagram representing photoreceptor electrostatic potentials and developed image toner densities at image boundaries for both the prior art and one embodiment.

Next, the advantages of the use of more conductive developer materials in the preferred embodiment will be discussed in connection with FIGS. 8 through 10. FIG. 8 is a combined voltage and toner density diagram illustrating toner development along image boundaries. the top line of FIG. 8 represents the magnitude of the charging voltage on the photoreceptor belt at sharp image boundaries which result from exposure of such an image segment in a copying machine or laser printing device. note that with positively charged toner materials of the type used in the preferred embodiment, the highest level shown in the top line would in fact be the most negative. However, it is useful to think in terms of the magnitude of the voltage tending to attract toner particles.

The middle line of FIG. 8 represents the density of the deposited toner using prior art resistive developer materials when the latent image portion represented in the top line is developed. NOte that for the extended highly saturated area shown at 120 there is a substantially constant toner density, although it varies to some degree. Near the boundaries, there is an increase in toner density shown at 121 in FIG. 8. Similarly, an increase in the density occurs near the relatively fine line of the image segment shown at 122 in FIG. 8. The difference between toner density for the broad fill saturated areas shown at 120 and the boundary edges shown at 121 and 122 is shown as D in FIG. 8, and represents the increased density at the boundary condition over the density for the filled area represented by dashed line 125.

The bottom line of FIG. 8 represents deposited developer density in developing the same image segment using toner materials having a bulk resistivity in the preferred range of $1\times10^8$ to $5\times10^9$ ohm centimeters in the preferred embodiment. There is a slight rounding of the boundary characteristics, but there is no increase in border density corresponding to areas 121 and 122 of the density shown for the prior art. Thus, even on the fine line shown in the latent image, the maximum toner density is substantially the same as the toner density for the filled area, as illustrated by line 125'. The phenomena represented by FIG. 8 is known in the prior art. As noted hereinabove, the conventional wisdom of the prior art is that the use of resistive developer materials to increase deposited density at the boundaries gives sharp looking edges. However, as noted above in the Background of the Invention section of this specification, it is believed by the inventors of the present invention that the use of resistive developer materials in color electrophotographic print engines explains the primary mechanism for halo problems.

Figure 9:
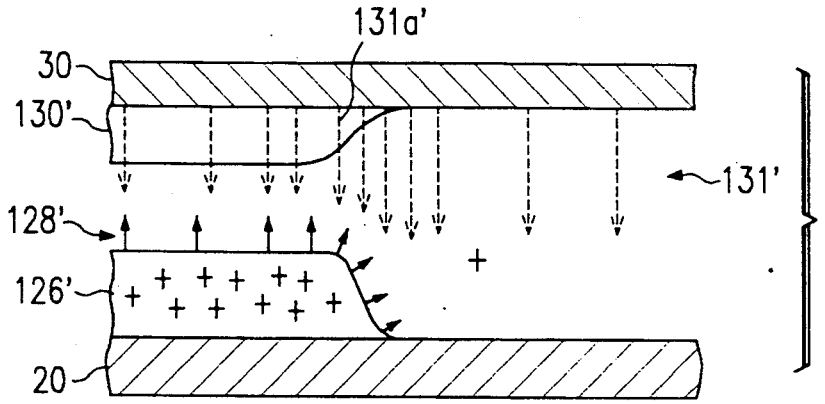
FIG. 9 illustrates a diagrammatic representation of the field gradients for transfer of a developed image onto a previously transferred developed image in a prior art color electrophotographic print engine.
Figure 10:
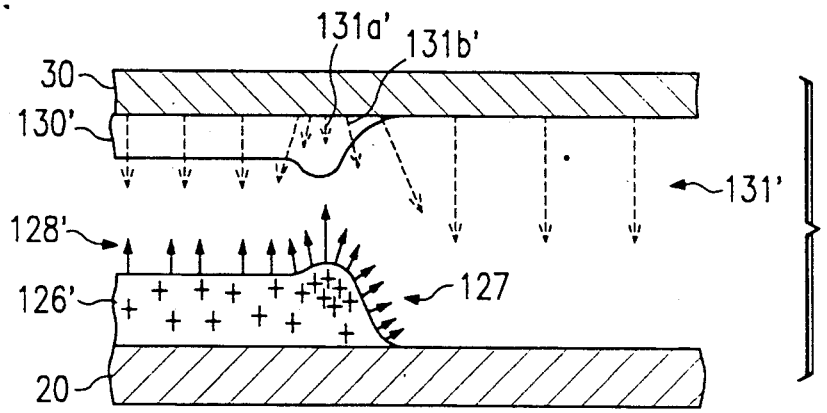
FIG. 10 illustrates a diagrammatic representation of the field gradients for a similar transfer in the preferred embodiment.

FIGS. 9 and 10 represent the inventors' belief as to the mechanism at work in the prior art and why the use of slightly more conductive materials in the preferred embodiment has been found to significantly reduce halo in full color electrophotography. FIG. 9 represents the circumstances in a prior art color electrophotographic machine wherein the second developed separated image is about to be transferred on top of the first between a photoreceptor 30' and an image receiving web 20'. Consider for a moment what has happened in the prior art when the first image was developed. The first toner materials shown as 126 in FIG. 9 exhibited the characteristic hump in deposited toner density at the image boundary. This is shown as substantially flattened in the previously transferred image illustrated in FIG. 9 due to the compression between photoreceptor 30' and image receiving web 20' which occurred as toner materials 126 moved through the transfer station. However, irrespective of the extent to which the boundary area of toner materials 126 were physically compressed, there is a higher charge density at the boundary as illustrated at 127. The arrows emanating from toner materials 126, shown generally at 128 in FIG. 9, represent the electrostatic forces tending to repel toner materials 130 as a result of the charge characteristics of previously transferred image 126. Therefore, arrows 128 increase a magnitude around the area 127 of increased charge density. The increase in charge at area 127 results from the fact that the density of toner materials at the boundary was increased (as illustrated in FIG. 8) and the fact that the toner material 126 is highly resistive. Therefore, this local maxima of charge cannot effectively dissipate during the time between successive transfers of separated images. The doted arrows point downward in FIG. 9, indicated generally at 131, represent the electrostatic forces by their lengths, and the electric field gradient by their orientations, of the field which results from the applied electric field between image receiving web 20' and photoreceptor 30' and the contributions represented by arrows 128) from the already transferred charged materials lying on web 20'.

It should be noted that there are two important aspects of the variation in the electric field gradient illustrated by arrows 131 as one moves from the dense area of the image on the left hand side of FIG. 9 toward the image boundary on the right. First, the minimum magnitude of the field gradient, illustrated by arrow 131*a*, occurs at the boundary itself. Therefore, the least force tending to attract toner materials 130 down toward image receiving web 20' occurs at the image boundary where consistent forward transfer is extremely important to the perceived quality of the resultant color image. Secondly, the maximum rotation of the field gradient occurs just outside the boundary, as illustrated by gradient vector 131*b*. As one proceeds toward the right of FIG. 9 the field gradient again straightens out and is perpendicular to photoreceptor 30' and image receiving web 20'. It is well known that charged particles will follow the field gradient when moving through an electrostatic field. Thus, the tendency in the prior art is for toner particles, particularly those represented in the excess of toner particles near the boundary for developed image 130, to move in the direction of gradient vector 131*b* and thus fall outside the boundary of the previously developed image 126. This causes significant halo to appear in the resultant developed image.

FIG. 10 illustrates what the inventors believe to be the circumstances prevailing in the preferred embodiments in which developer materials having a conductivity falling within the above recited range are used. The first transferred image is shown as 126' and the second transferred image is shown as 130'. The electric field repulsive forces from previously transferred image 126' are indicated at 128'. First, it should be noted that the plus signs within developed image 126' indicate a substantially uniform charge per unit volume characteristic for the first transferred image. One result is that the use of the conductive developer materials does not create increased deposited toner density at boundary areas when the image is originally developed on the photoreceptor, as illustrated by the bottom line of FIG. 8. Thus, arrows 128' in FIG. 10 are shown as being of substantially equal length until one reaches the extremes of the boundary area where the charge per unit volume drops off. Therefore, there is no increase in the electrostatic repulsion forces represented by arrows 128' at the boundary.

It will therefore be appreciated that arrows 131', which again represent both the strength of the electrostatic attraction, through their length, and the field gradient, through their orientation, indicate that there is no substantial diminution in the attractive force at the boundary of the second developed image 131. Again, maximum rotation of the field gradient occurs at the boundary as illustrated by arrow 131*a'*. However, in the preferred embodiment, the rotation of the field gradient is less. Therefore, there tends to be a good uniform transfer of materials from second image 130' on top of first image 126' at the boundary area. This significantly reduces the halo problems encountered in the prior art.

In passing, it should also be noted that the use of stepwise increasing triboelectric charge characteristics help prevent halo problems which would be exacerbated by the stepped triboelectric charge characteristics of the device disclosed in U.S. Pat. No. 4,093,457 to Hauser. If one considers the situation of FIG. 9 in connection with Hauser's use of a very high triboelectric charge characteristic for the first image, it will be appreciated that the repulsive forces from an increase in toner density in area 127 will be particularly strong for the first image transferred to web 20'. The physical concentration of materials having a very high triboelectric charge will tend to exacerbate the rotation of the field gradient, thus assuring that a substantial portion of the toner at the boundary region of the second developed image will fall outside the true image boundary, thus exacerbating the halo phenomenon.

Lastly, as noted hereinabove, the present invention is useful in any machine using an electrophotographic print engine having an approximate image signal source which can determine particular pixel areas having significantly saturated dark colors, particularly those tending toward black. It is within the scope of the present invention to use only black materials to develop these regions as well as to overlay combinations of the three process toners tending to produce process black with a monochromatic black toner. It should be noted that the phrase overlay used in the above statement refers to the resultant order of toners which appears on the paper and thus black, as noted hereinabove, will be the first toner material laid down on transfer belt 20. Therefore, if reference is made to FIG. 5B the black toner materials will lie above yellow toner materials 88 illustrated thereon.

In connection with this, the black materials can be most efficiently transferred as the first image to leave photoreceptor belt 30 onto transfer belt 20 since there is no way to practically diminish the photoreceptor's hold on the materials through the use of predischarge lamp 42 (FIG. 1). However, since black will be the first image laid down, it is assured that at least the surface of transfer belt 20 will present a uniform charge per unit area characteristic to the black image.

Again, considering for a moment the circumstances at transfer belt to image receptor transfer station 32, as illustrated in FIG. 5A, the black toner materials, being the first to be laid on the transfer belt 20 will be on top of the ultimate image which appears on paper 35. As noted above, it is the developed image closest to transfer belt 20 which is the most difficult to transfer. However, in a four color process slightly inconsistent forward transfer of the black toner materials from transfer belt 20 onto image receptor 35 will do minimum harm since the other three toner materials are available to generate processed black when fused. Thus, the failure to uniformly make a forward transfer of the material closes to transfer belt 20 only results in very modest variations in the saturation of the dark areas of a final image main use of the black materials, and does not lead to a spectral distortion.

As noted hereinabove, the present invention can, in many ways, be properly characterized as a selection of all of the foregoing important parameters so that the transfer mechanisms in electrophotographic print engine cooperate in the best way possible to produce a very high quality final image having good uniformity of color and saturation in highly saturated image areas, minimum halo at the boundaries between saturated areas and light areas of the image, minimum back transfer, and efficient uniform toward transfer during the development process. Many of the teaching and inventive aspects embodied in transfer station 32 are equally applicable to single transfer machines where transfer is made directly from a photoreceptor to a final image receptor. Naturally in such a machine it is preferable to reverse the order of development of pigments so that the yellow pigment (in a three color system) remains the top pigment of the final image receptor. The present inventors have set forth several physical models which they believe properly explain the phenomenon creating problems in the prior art. It is not the intent of this specification to state that these models are rigorously correct, but the inventors believe they are appropriate descriptions of the phenomenon which take place. The information gained from the use of these models has been used in creating the present invention and, it performs in accordance with the theory represented by the models, at least in the significantly improved color image results obtained.

Figure 11:
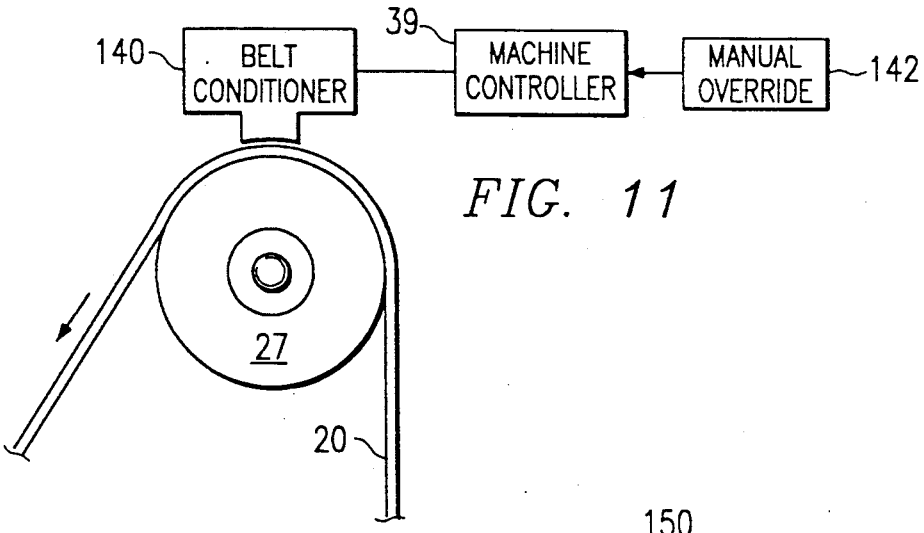
FIG. 11 illustrates a detailed illustration of the mechanism for cleaning the transfer belt.

Referring now to FIG. 11, there is provided a detail of the mechanism for cleaning the transfer belt 20. FIG. 11 illustrates the opposite view of the roller 27 as illustrated in FIG. 1.

The cleaning operation and the conditioning operation of the present invention are provided by a belt conditioner 140. The belt conditioner 140 is controlled by the machine controller 39, which, as will be described hereinbelow, has a manual override device 142 associated therewith which is operable to provide some manual control of the belt conditioner 140.

The belt conditioner 140 is operable to provide both a cleaning operation for the belt and also a "conditioning" of the belt. This conditioning is directed primarily toward the surface characteristics of the transfer belt 20 including among others the surface energy. Although the actual surface characteristics that affect the copies are not well understood, it is believed that some surface contamination occurs which alters such things as the surface energy, the cleaning efficiency, etc.

In the preferred embodiment, the belt conditioner 140 provides a cleaning and a conditioning operation. This is performed in two steps. The first step provides a less aggressive cleaning step and the second step provides a more aggressive conditioning step. The cleaning operation is done every page after transfer of the final composite image, whereas the conditioning step is done on a page intermittent basis. This conditioning step on the page intermittent basis is to be compared to the cleaning step which is performed every page but on a plane intermittent basis, i.e., after every third plane of component image transfer to the transfer belt 20. Therefore, for every three revolutions, in the operation of the transfer belt 20, the cleaning operation is activated. However, in the preferred embodiment the conditioning portion of the belt conditioner 140 is only activated once every ten pages or thirty revolutions of the transfer belt 20. When the conditioning step is activated, exposure and development of images on the PC belt 30 is inhibited to allow the conditioning operation to be completed for one full revolution of the transfer belt 20. This is due to the fact that the conditioning operation of the belt conditioner 140 is not necessarily needed every page and, in the preferred embodiment, the aggressive interaction between the belt conditioner 140 and the transfer belt 20 during the conditioning operation could result in slippage and resultant registration problems. Therefore, the machine controller 39 inhibits normal operation of the machine during this period of time. Of course, this only results in one revolution of the belt 20 out of thirty revolutions for the conditioning operation, or a 2.5% overhead. If, on the contrary, the conditioning operation of the belt conditioner 140 were activated for each cycle, this would mean that four revolutions were required for every composite image having three component images, resulting in a 25% overhead.

In operation, the belt conditioner 140 is operable in two modes. In the first mode, it primarily performs a cleaning function and, in the second mode, it performs a belt conditioning function. However, it should be understood that both the cleaning and the belt conditioning function are essentially conditioning functions that vary in the effect they have on the belt 20. In the preferred embodiment, there are essentially two conditioning processes, one more aggressive than the other, as will be described in more detail hereinbelow. Further, it is belived that the second conditioning process may deposit a material onto the belt itself, which material is responsible for the conditioning process.

Generally, the belt 20 must make three revolutions per page in order to receive from the PC belt 30 the three component images that make up the composite image. After the reception of the third component image, the composite image is transferred to the paper 35. At the end of each page after the transfer of the composite image from the belt 20 to the paper 35, it is necessary to remove any excess toner, etc. that may be present on the belt 20 in order to initiate the cycle for the next copy. In the preferred embodiment, the second stage of operation for the belt conditioner 140 occurs on a page intermittent basis; that is, it occurs once every n pages which, in the preferred embodiment, is approximately ten, such that the second stage of operation for the belt conditioner 140 occurs only once in every ten pages.

At the nth page, the belt conditioner 140 is operated in its second mode of operation after the previously completed composite image has been transferred from the transfer belt 20 to the sheet of paper 35. Thereafter, the transfer belt 20 is cycled one complete revolution without transferring a developed image from the PC belt 30 to the transfer belt 20. The machine controller 39, as described above, inhibits the exposure and development process during this period of time, or, more precisely, it delays it for one cycle of the transfer belt 20. The purpose of this is to allow the belt conditioner 140 to interface with the belt 20 without regard to the registration problems that may exist when any external operation is performed on the transfer belt 20.

At certain times, there may be problems with copies that are produced in the machine. Since the belt conditioner 140 operates only after n pages, it is sometimes desirable to override the timing sequence such that the belt conditioner 140 operates in its second mode of operation prior to cycling through ten pages in the copying process. A manual override switch 142 is provided for this purpose.

Figure 12:
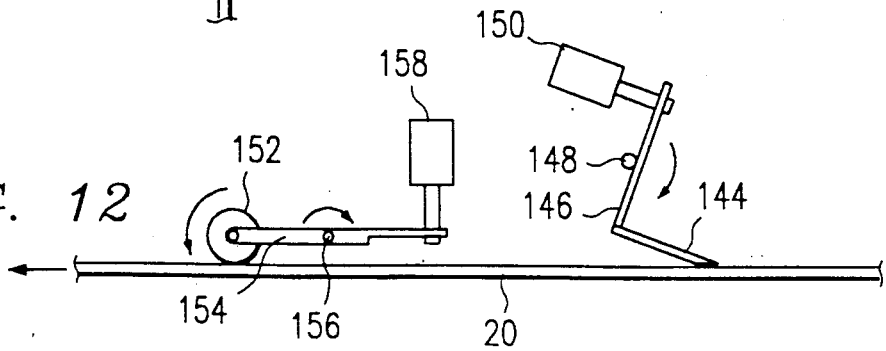
FIG. 12 illustrates a more detailed operation of the belt conditioner.

Referring now to FIG. 12, there is illustrated a more detailed diagram of the belt conditioner 140 in the preferred embodiment. The belt conditioner is comprised of a cleaning blade 144 which is attached to a supporting member 146 that is pivoted about a pivot point 148. A solenoid 150 is operable to activate the member 146 and rotate the leading edge of the cleaning blade 144 away from contact with the belt 20. For simplicity purposes, the belt 20 is illustrated in a flat topography, whereas, in the preferred embodiment, the cleaning blade 144 is disposed proximate to the surface of the roller 27 and separated by the belt 20. The cleaning blade 144 is illustrated in the cleaning position with respect to the transfer belt 20.

A roller 152 is provided which is attached to the end of a supporting member 154 and is operable to rotate thereon. The roller 152 is elongated (not shown) along the surface of the transfer belt 20, the longitudinal axis thereof perpendicular to the direction of travel of the transfer belt 20. The member 154 is pivotally attached to a point 156 with a solenoid 158 operable to rotate the roller 152 away from the surface of the transfer belt 20. The solenoids 150 and 158 are controlled by the machine controller 39.

The roller 152 is operable to counter rotate against the surface of the transfer belt 20 when in contact therewith. The velocity at the surface of the roller 152 relative to the surface of the belt 20, the pressure thereof, the surface characteristics of the roller 152, and the material from which the roller is fabricated all comprise parameters that determine how aggressively the roller 152 conditions the surface of the transfer belt 20. The roller 152 can be a very fine brush, or it can be a smooth surface, the latter being utilized in the preferred embodiment. Since the roller 152 more aggressively interacts with the surface of the belt 20, there is the possibility of slippage occurring which can greatly affect registration. Therefore, the delay in operation of the machine is utilized in the present invention to prevent any problems with registration on a given copy. However, in some applications this registration problem may be tolerated, and therefore, the second stage of operation for the belt conditioner 140 utilizing the roller 152 could be integrated every n pages without delaying the exposure and development operation for one "plane" of operation. Further, the value of n is selected as a function of the effect that the roller 152 has on the surface characteristics, both beneficial and detrimental. It has been noticed that one characteristic of the transfer belt 20, the surface energy, has some deleterious effects on the copies if it gets too high. The roller 152 has the effect of lowering the surface energy. However, if the roller 152 is utilized for every page of operation, it will decrease the surface energy to a lower level and this may result in inadequate transfer from the PC belt 30. By utilizing the roller 152 on a page intermittent basis, the roller 152 is only utilized at a point when the surface energy has increased too high, or more importantly, when the surface characteristics in the transfer belt 20 which cause deleterious effects in the final copies have reached a point that is unacceptable. It is desirable to increase the number of pages between sequential operations of the roller 152 to lower the overhead required for this operation. Of course, the velocity and pressure of the roller 152 can be altered to either increase or decrease the effect it has on the transfer belt 20 also.

The roller 152 is fabricated from a fluropolymer material that has a surface energy that is lower than the surface energy of the belt 20. In the preferred embodiment, the material is a fluroplastic utilizing a PFA (perfluroalkoxy) resin which is manufactured and sold by DuPont Company under the TEFLON trademark.

In tests run by applicant, the surface energy of the belt 20, which is a polycarbonate material, is between 37–38 dyne-cm. Without utilizing the conditioning process of the present invention, this surface energy increases up to a level of between 40–45 dyne-cm. It has been noticed by applicant that transfer problems occur when the surface energy increases above 40 dyne-cm. Removal of the belt and cleaning thereof in alcohol will reduce the surface energy back down to the 37–38 dyne-cm. level. This cures the problem temporarily, until the surface energy once again rises as a result of use. Therefore, it is believed that the conditioning process described above operates to reduce the surface energy.

One mechanism in the above-described conditioning process that is believed to contribute to the reduction of the surface energy is the type of material from which the roller 152 is fabricated, which is a fluorocarbon based material having a very low surface energy, much less than 30 dyne-cm. It is believed that a very thin coating of the fluorocarbon material is deposited onto the belt 20 in the conditioning process, thus causing a reduction in the surface energy due to the low surface energy of the thin layer. When this thin coating wears off, the surface energy again increases. The surface energy of belt 20 is not reduced to that of the fluorocarbon material but, rather, it is reduced to somewhere between 35–40 dyne-cm. As an alternative to depositing something onto the belt 20 to reduce the surface energy, an actual cleaning process wherein a solvent such as alcohol was actually deposited onto the belt 20 could also be utilized to reduce the surface energy and alter the surface characteristics of the belt.

Referring now to FIGS. 13*a*–13*c*, there are illustrated detailed mechanical views of the belt conditioner 140 illustrating the roller 152 and the cleaning blade 144. Referring specifically to FIG. 13*a*, the roller 152 is rotationally mounted on the end of a pivoting mechanism 160 which pivots about a point 161. The mechanism 160 has the roller 152 rotationally mounted on one end thereof in a housing 162. The other end of the mechanism 160 rests upon the outer surface of a cam 164 which is mounted on a longitudinal rod 166. The mechanism 160 has a separate adjustment plate 165 disposed on the end thereof that actually contacts the outer surface of the cam 164, the distance between the actual end surface of the mechanism 160 and the lower surface of the adjustment member 165 determined by an adjusting screw 168. The adjusting screw 168 determines the positional relationship of the outer surface of the roller 152 with respect to the belt 120. In FIG. 13*a*, the cleaning blade 144 is illustrated as being mounted on the end of a rocking plate 170 that is pivoted about a point 172. The rocking plate 170 is activated by the solenoid 150.

Referring now to FIG. 13*b*, there is illustrated a side view of the actual drive mechanism for driving the roller 152. The drive mechanism is generally comprised of a plurality of gears arranged in a gear assembly, of which one, gear 172, is directly attached to the end of the roller 152. The roller 172 interacts with the remaining gears in the drive mechanism. A main drive gear 174 is provided which interacts with the main drive motor of the copy machine (not shown). When installed, another gear co-acts with the gear 170 to impart a driving force thereto. The main driving gear 174 drives the remaining gears in the gear assembly of FIG. 13*b*. The gear assembly also drives a gear 176 which interacts with a clutch 178. The clutch 178 is a slip type clutch which has an outer surface 180 that slips with respect to the clutch 178. The outer surface 180 has a single projection 182 disposed on the outer periphery thereof. The projection 182 acts as a stop. The stop 182 is operable to be in either the downward position or the upward position. The outer surface 180 is connected to the cam 164 through the longitudinal rod 166 such that when the step 182 is in the downward position, the cam is positioned such that the roller 162 is raised from the surface of the belt 20. When the stop 182 is in the upwardly directed position, the cam 164 is positioned such that the roller 152 contacts the surface of the belt 20.

A lever mechanism 184 is provided which has an upper extended arm 186 and a lower extended arm 188. The upper arm 186 has a downward projection on the end thereof which is operable when lowered downward toward the outer surface 180 to contact the stop 182 when it is in the upward position. The lower arm 188 of the assembly 184, when moved upward toward the outer surface 180 operates to contact the stop 182 in the downward position. The assembly 184 pivots about a point 190 such that rotation thereabout causes the arms 186 and 188 to move up and down in response to the action of the solenoid 158 which is attached to the arm 188. The solenoid 158 operates in a first mode to pull the arm 188 downward away from the outer surface 180, thus also moving the arm 186 downward toward the outer surface 180. This releases the stop 182 allow the outer surface 180 to rotate until the stop 182 contacts the arm 186. When the solenoid 158 is deenergized, the arm 188 moves upward and the arm 186 moves upward. This allows the outer surface 180 to rotate until the stop contacts the end of the arm 188. The action of the solenoid 158 thus rotates the cam 164 in 180° increments.

Figure 14:
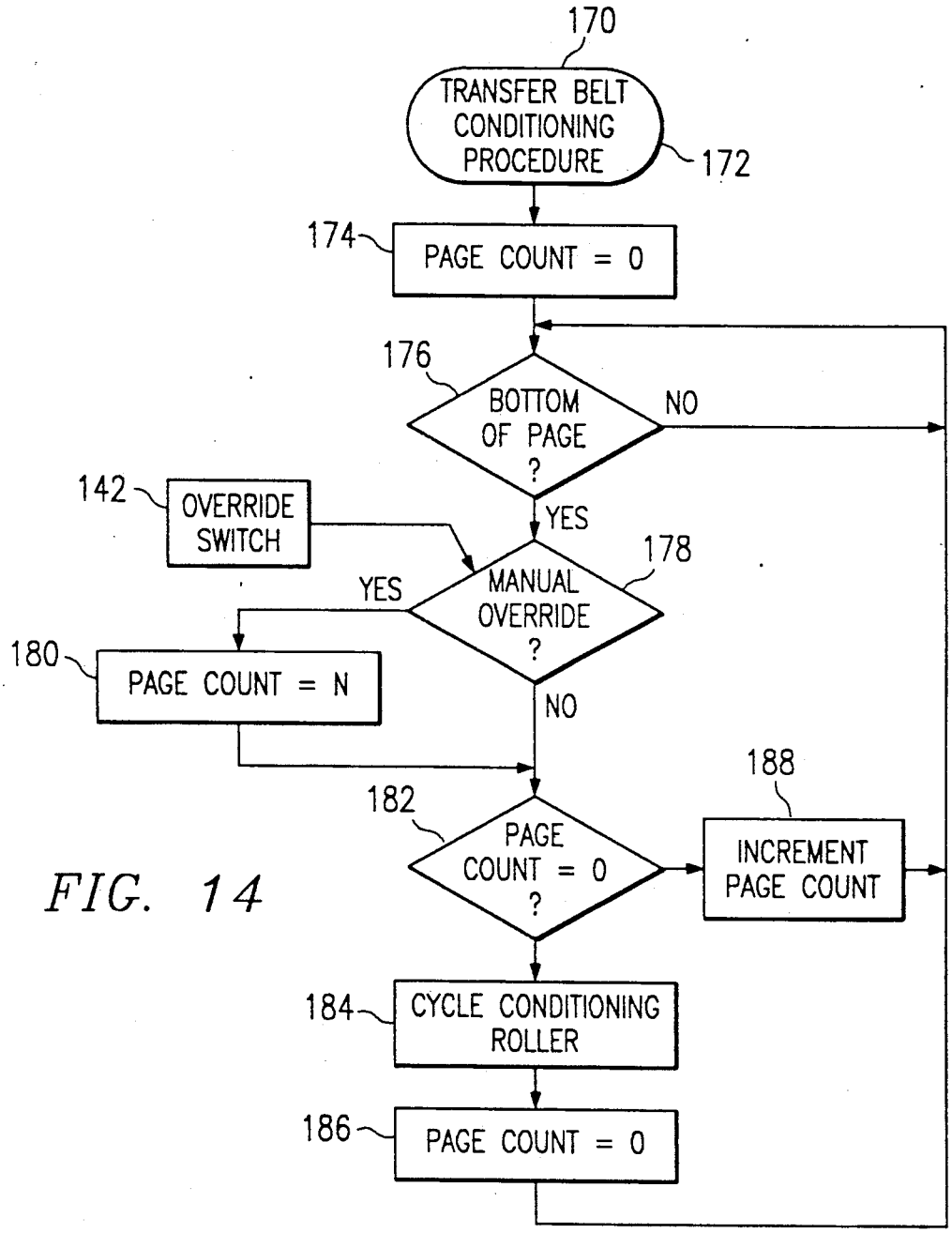
FIG. 14 illustrates a flow diagram for the operation of the conditioning procedure.

Referring now to FIG. 14, there is illustrated a flow diagram for the operation of the conditioning procedure. The program is initiated at a start block 202 and then proceeds to a function block 204 to set the page count equal to zero. The program flows to a decision block 206 to determine if the bottom of the page has been reached. If so, the program proceeds along a "Y" path, and if not, the program flows back to the input of decision block 206 along an "n" path. When the bottom of the page has been reached, the program flows to a function block 208 to determine if the manual override switch has been depressed. If so, the program flows along a "Y" path to a function block 210 to set the page count equal to N, if not, the program flows along an "N" path to a decision block 212. The output of function block 210 also flows to the input of decision block 212. At decision block 212 a determination is made as to whether the page count is equal to n. If yes, this indicates that the conditioning roller 152 is to be activated and the program flows along a "Y" path to a function block 214 to cycle the conditioning roller 152. During the cycling procedure, as described above, the machine controller 39 inhibits exposure and development and subsequent transfer of a component image to transfer belt 20 from the PC belt 30.

After conditioning, the page count is set equal to zero, as is indicated in a function block 216 and the program flows back to the input of decision block 206. If the page count is not equal to n, the program flows from decision block 212 along an "N" path to a function block 218 to increment the page count and then back to the input of decision block 206.

In summary, there has been provided a belt conditioning process whereby an intermediate transfer belt in a flexible belt system is conditioned on a page intermittent basis in a manner that differs from a normal cleaning procedure. Once every n pages, formation and transfer of the images is inhibited and the transfer belt is more aggressively conditioned to alter the surface characteristics thereof. The transfer belt is cycled one complete revolution during this conditioning cycle and then the system is returned to normal operation.

Although the preferred embodiment has been described in detail, it should be understood that various changes, substitutions and alterations can be made therein without departing from the spirit and scope of the invention as defined by the appended claims.

We claim:

1. An electrophotographic print engine having a flexible belt for transporting at least one developed image for transfer therefrom at the end of a complete page and including page intermittent conditioning means for conditioning said flexible belt to alter the surface characteristics thereof in a first predetermined conditioning process on a page intermittent basis with said conditioning mean held inoperative for at least one page in a sequence of n pages processed by the print engine.

2. The print engine of claim 1 wherein said conditioning means operates only after transfer of said image from said flexible belt.

3. The print engine of claim 1 wherein said conditioning means further comprises non-page intermittent means for conditioning said flexible belt to alter the surface characteristics thereof in a second predetermined conditioning process on a non-page intermittent basis such that conditioning of said belt operates on each page.

4. The print engine of claim 3 wherein said non-page intermittent conditioning means operates only after transfer of said image from said flexible belt.

5. The print engine of claim 3 wherein said non-page intermittent conditioning means comprises a cleaning blade for removing any residual portion of said image from said flexible belt after transfer therefrom.

6. The print engine of claim 5 wherein said page intermittent conditioning means comprises a longitudinal roller that counter rotates relative to the direction of travel of the belt and contacts the surface of the belt at a predetermined pressure.

7. The print engine of claim 6 wherein the surface of said longitudinal roller is fabricated from a fluropolymer and said flexible belt is fabricated from a polycarbonate material.

8. The print engine of claim 6 wherein said longitudinal roller is operable to reduce the surface energy of said flexible belt.

9. The print engine of claim 1 wherein said flexible belt is operable to receive overlapping and previously developed multiple component images to form a single composite image for each page of operation of the print engine, and further comprising:

a transfer device for transferring said composite image to a receiving body after formation thereof; and said page intermittent conditioning means operable after said composite image is transferred and before the first composite image for the next page is received, and operating after at least one page in a sequence of n pages has been processed by the print engine.

10. The print engine of claim 9 and further comprising means for inhibiting receipt of developed component images onto said flexible belt during operation of said page intermittent conditioning means.

11. An electrophotographic print engine, comprising:

a developing station for forming electrophotographic images;

a transport mechanism for transporting the formed images from the developing station;

a continuous intermediate transfer belt for receiving images from the transport mechanism;

a first transfer mechanism for causing the images from the transport mechanism to transfer to said intermediate transfer belt;

a receiving body for receiving from said transfer belt the electrophotographic image contained thereon;

a second transfer mechanism for causing the images from said transfer belt to transfer to said receiving body;

a cleaning mechanism for cleaning the surface of said intermediate transfer belt after transfer of at least a portion of an image from said transfer belt to said receiving body;

a conditioning mechanism for conditioning the surface of said intermediate transfer belt after transfer of at least a portion of an image to said receiving body from said transfer belt; and a controller for controlling the operation of said conditioning mechanism independent of the operation of said cleaning mechanism.

12. The print engine of claim 11 wherein said controller controls said conditioning mechanism to operate after n pages of images have been transferred from said intermediate transfer belt to said receiving body, the value of n being greater than one.

13. The print engine of claim 12 wherein the operation of said first and second transfer mechanism is inhibited during the operation of said conditioning mechanism such that images are not transferred from said developing station to said transfer belt during operation of said conditioning mechanism.

14. The print engine of claim 12 wherein each of the images transferred from the intermediate transfer belt to the receiving body comprise a composite image formed from overlaying a plurality of component images, the images formed at the developing station comprising the component images, said first transfer mechanism operable to synchronize transfer of said component images in an overlapping manner onto said intermediate transfer belt to form said composite image, the formation of said composite image on said intermediate transfer belt constituting a page cycle in the print engine, said second transfer mechanism operable to transfer the composite image to the receiving body from the intermediate transfer belt at the end of a page cycle.

15. The print engine of claim 14 wherein said controller is operable to control said conditioning mechanism to operate on a page intermittent basis such that said conditioning mechanism is activated at a minimum of at least every other page cycle in the print engine.

16. The print engine of claim 15 and further comprising an overriding mechanism for overriding the operation of said controller on a page intermittent basis to cause said conditioning mechanism to operate at the end of the page cycle of the print engine during which said mechanism is activated.

17. The print engine of claim 11 wherein said conditioning mechanism comprises a longitudinal roller having a longitudinal axis that is perpendicular to the direction of travel of said transfer belt, said roller counter rotating relative to the direction of travel of said intermediate transfer belt and operable in a first mode to contact the surface of intermediate transfer belt to provide the conditioning of the surface thereof and in a second mode to be removed from the surface of said intermediate transfer belt when said conditioning mechanism is not performing the conditioning operation.

18. The print engine of claim 17 wherein said roller is fabricated from a fluropolymer and said transfer belt is fabricated from polycarbonate material.

19. The print engine of claim 11 wherein said cleaning mechanism comprises a cleaning blade for being disposed adjacent the surface of said intermediate transfer belt at a predetermined pressure and angle to perform the cleaning operation, said cleaning blade operable to be removed from the surface of said intermediate transfer belt until the leading edge of the image on said intermediate transfer belt has been transferred to said receiving body.

20. The print engine of claim 11 wherein said conditioning mechanism is operable to change the surface energy of said transfer belt.

21. An electrophotographic print engine, comprising:

a developing station for forming a sequence of component electrophotographic images, m component images forming a composite image;

a transport mechanism for transporting the formed images from the developing station;

a continuous intermediate transfer belt for receiving said component images from said transport mechanism;

a first transfer mechanism for causing said component images to be transferred from said transport mechanism to said transfer belt in an overlapping manner to form said composite image;

a receiving body for receiving form said transfer belt said composite image;

a second transfer mechanism for causing said composite image after formation thereof to be transferred from said transfer belt to said receiving body once every n cycles of said transfer belt to alter the surface characteristics thereof;

a cleaning mechanism for cleaning the surface of said intermediate transfer belt, said cleaning mechanism operable in a first mode for contacting the surface of the belt to perform the cleaning operation and in a second mode to be removed from the belt;

a first controller for controlling said cleaning mechanism to operate in the first mode after the leading edge of said composite image is transferred from said transfer belt to said receiving body and for being operated in the second mode when a portion of said transfer belt on which the trailing edge of said composite image was formed passes said cleaning mechanism;

a conditioning mechanism for conditioning the surface of said transfer belt after transfer of said composite image to said receiving body from said transfer belt; and a controller for controlling the operation of said conditioning mechanism independent of the operation of said cleaning mechanism and on a page intermittent basis, the operation of said developing station and said first and second transfer mechanisms inhibited during operation of said conditioning mechanism.

22. The print engine of claim 21 and further comprising override means for overriding the operation of said controller operating on said page intermittent basis to force said cleaning mechanism to operate in response to said override means and upon transfer of the next to be formed one of the composite images.

23. The print engine of claim 21 wherein said conditioning mechanism comprises a roller for contacting the surface of said transfer belt during the conditioning operation thereof, said roller counter rotating with respect to the direction of travel of said transfer belt and having a predetermined velocity at the surface thereof and a predetermined pressure on the surface of said transfer belt.

24. The print engine of claim 21 wherein said roller is fabricated from a fluropolymer and said transfer belt is fabricated from polycarbonate material.

25. The print engine of claim 21 wherein said conditioning mechanism is operable to change the surface energy of said transfer belt.

26. A method for conditioning a flexible belt in an electrophotographic print engine comprising the steps of:

transporting at least one developed image on the flexible belt for transfer therefrom at the end of a page cycle to a receiving body;

conditioning the flexible belt at a first and predetermined conditioning level to alter the surface characteristics thereof on a page intermittent basis; and the step of conditioning held inoperative for at least one page in a sequence of n pages transferred by the flexible belt.

27. The method of claim 26 wherein the step of conditioning operates only after transfer of the image from the flexible belt to the receiving body.

28. The method of claim 26 and further comprising conditioning the flexible belt at a second and predetermined conditioning level on a non-page intermittent basis such that conditioning of the flexible belt at the second conditioning level operates on each page.

29. The method of claim 28 wherein the second step of conditioning operates only after transfer of the image from the flexible belt.

30. The method of claim 28 wherein the step of transporting at least one developed image on the transfer belt for transfer therefrom comprises:

receiving overlapping and previously developed multiple and sequential component images on the flexible belt to form a single composite image for each page of operation;

transferring the composite image to the receiving body after formation thereof; and the step of conditioning operating after the composite image is transferred to the receiving body and before the first component image for the next page is received during at least one page in the sequence of n pages processed by the flexible belt.

31. The method of claim 30 and further comprising inhibiting receipt of component images onto the flexible belt during operation during the step of conditioning.

32. The method of claim 28 wherein the second conditioning level in the second step of conditioning comprises positioning a cleaning blade adjacent the flexible belt for removing any residual portion of the image from the flexible belt after transfer therefrom to the receiving body.

33. The method of claim 32 wherein the step of conditioning comprises disposing a longitudinal roller that counter rotates relative to the direction of travel of the flexible belt against the surface of the flexible belt.

34. The method of claim 33 wherein the roller is fabricated from a fluropolymer and the flexible belt is fabricated from a polycarbonate material.

35. The method of claim 26 wherein the step of conditioning the flexible belt is operable to alter the surface energy thereon.

* * * * *